US007470494B2

(12) United States Patent
Nishiyama et al.

(10) Patent No.: US 7,470,494 B2
(45) Date of Patent: Dec. 30, 2008

(54) MAGNETIC TONER

(75) Inventors: Junko Nishiyama, Mishima (JP); Yoshihiro Ogawa, Numazu (JP); Yusuke Hasegawa, Shizuoka-ken (JP); Shinichiro Abe, Toride (JP); Takashige Kasuya, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 11/168,506

(22) Filed: Jun. 29, 2005

(65) Prior Publication Data

US 2006/0078811 A1 Apr. 13, 2006

(30) Foreign Application Priority Data

Oct. 8, 2004 (JP) ..... 2004-296445

(51) Int. Cl.
*G03G 9/083* (2006.01)

(52) U.S. Cl. ..... 430/106.1; 430/109.4

(58) Field of Classification Search ..... 430/106.1, 430/109.4

See application file for complete search history.

(56) References Cited

U.S. PATENT DOCUMENTS

| | | | | |
|---|---|---|---|---|
| 4,146,082 | A | 3/1979 | Granger | 164/254 |
| 4,206,064 | A | 6/1980 | Kiuchi et al. | 252/62.1 P |
| 4,404,271 | A | 9/1983 | Kawagishi et al. | 430/108.3 |
| 5,106,815 | A | 4/1992 | Akada et al. | 503/229 |
| 5,356,712 | A | 10/1994 | Hashiuchi et al. | 428/404 |
| 5,688,852 | A | 11/1997 | Misawa et al. | 524/431 |
| 5,759,435 | A | 6/1998 | Miyazono et al. | 252/62.59 |
| 6,002,212 | A | 12/1999 | Gagnot et al. | 315/291 |
| 6,007,957 | A | 12/1999 | Kobori et al. | 430/106.6 |
| 6,013,193 | A | 1/2000 | Hashiuchi et al. | 252/62.59 |
| 6,059,988 | A | 5/2000 | Hashiuchi et al. | 252/62.58 |
| 6,238,834 | B1 | 5/2001 | Tamura et al. | 430/106.6 |
| 6,416,864 | B1 * | 7/2002 | Hayashi et al. | 428/403 |
| 2004/0265729 | A1 | 12/2004 | Patel | 430/137.14 |
| 2005/0026089 | A1 | 2/2005 | Ogawa et al. | 430/405 |
| 2006/0078812 | A1 | 4/2006 | Hasegawa et al. | 430/106.1 |

FOREIGN PATENT DOCUMENTS

| | | | |
|---|---|---|---|
| EP | 1 324 143 | A2 | 7/2003 |
| EP | 1 403 723 | A2 | 3/2004 |
| JP | 41-020153 | | 11/1966 |
| JP | 42-027596 | | 12/1967 |
| JP | 44-006397 | | 3/1969 |
| JP | 45-026478 | | 9/1970 |
| JP | 50-133838 | | 10/1975 |
| JP | 55-042752 | | 11/1980 |
| JP | 58-007384 | | 2/1983 |
| JP | 58-041508 | | 9/1983 |
| JP | 59-007385 | | 2/1984 |
| JP | 05-072801 | | 3/1993 |
| JP | 05-213620 | | 8/1993 |
| JP | 06-144840 | | 5/1994 |
| JP | 07-110598 | | 4/1995 |
| JP | 07-175262 | | 7/1995 |
| JP | 07-239571 | | 9/1995 |
| JP | 08-048524 | | 2/1996 |
| JP | 08-050369 | | 2/1996 |
| JP | 08-025747 | | 3/1996 |
| JP | 08-101529 | | 4/1996 |
| JP | 08-208236 | | 8/1996 |
| JP | 08-208237 | | 8/1996 |
| JP | 09-059024 | | 3/1997 |
| JP | 09-509025 | | 9/1997 |
| JP | 11-153882 | | 6/1999 |
| JP | 11-157843 | | 6/1999 |
| JP | 11-189420 | | 7/1999 |
| JP | 11-249335 | | 9/1999 |
| JP | 11-282201 | | 10/1999 |
| JP | 11-316474 | | 11/1999 |
| JP | 3009045 | | 12/1999 |

OTHER PUBLICATIONS

European Search Report dated Apr. 29, 2008 regarding Application No./Patent No. 05013968.2-1217.

* cited by examiner

*Primary Examiner*—John L Goodrow
(74) *Attorney, Agent, or Firm*—Fitzpatrick, Cella, Harper & Scinto

(57) ABSTRACT

According to the present invention, a magnetic toner comprising magnetic toner particles including at least a binder resin and magnetic particles is provided, wherein an isoelectric point of the magnetic particles is pH 4.0 or less, in order to provide a magnetic toner stably having an optimum charged amount regardless of environments so that a high-quality image having high blackness can be formed without causing any ghost phenomenon.

8 Claims, No Drawings

MAGNETIC TONER

BACKGROUND OF THE INVENTION

1. Field of the Invention

The present invention relates to a magnetic toner for use in image forming methods such as an electrophotographic method, an electrostatic recording method, a magnetic recording method and a toner jet system recording method.

2. Description of the Related Art

As an electrophotographic method, a large number of techniques have been known. Generally, a photoconductive material is used, and an electrostatic latent image is formed on a photosensitive member by any of various means. Then, the electrostatic latent image is developed with a toner, and the resultant toner image is subsequently transferred to a transfer material such as a paper, if necessary. Thereafter, the transferred toner image is fixed by heating, pressurizing, heating and pressurizing, a solvent vapor or the like to obtain a subject image. The developer which has not been transferred and thus left on the photosensitive member is removed by any of various methods to clean the photosensitive member. The above-described steps are then repeated.

In this technique, as the developing method, a one-component developing process is preferably used, because in one-component developing process, a developing unit having a simple structure is used with less troubles, and it has a long life and its maintenance is easy.

In such a one-component developing process, the quality of a formed image depends largely on the performance of a magnetic toner to be used. In the magnetic toner, a considerable amount of magnetic particles in the state of fine powder is mixed and dispersed, and part of the magnetic particles are exposed on the surface of the magnetic toner. Therefore, the kind of magnetic particles has an influence on fluidity and frictional electrification of the magnetic toner, and consequently, on various properties such as developing properties and durability required in the magnetic toner. Accordingly, with regard to the magnetic particles contained in the magnetic toner, various proposals have heretofore been made.

Furthermore, in order to improve the properties of the magnetic particles, preparation methods have heretofore been investigated in which, during a reaction for producing the magnetic particles, silicon is added to a reaction system. For example, there has been a method which comprises the successive steps of adding a silicon component to a ferrous salt solution, mixing the solution with 1.0 to 1.1 equivalents of an alkali to iron, carrying out an oxidative reaction while a pH is maintained at 7 to 10, adding 0.9 to 1.2 equivalents of iron to the original alkali during the reaction, and carrying out the oxidative reaction while the pH is maintained at 6 to 10, to thereby obtain the magnetic particles (e.g., see Japanese Patent Publication No. 8-25747, and Japanese Patent Application Laid-Open No. 5-213620). Furthermore, there has been another method in which when an oxygen-containing gas is passed through an aqueous ferrous salt solution containing ferrous hydroxide colloid obtained by allowing $Fe^{2+}$ to react with 0.80 to 0.99 equivalent of an alkali hydroxide to produce the magnetic particles, 0.1 to 5.0 atom % of a water-soluble silicate in terms of Si to iron is added to the aqueous solution, and then, a two-stage reaction is performed to obtain the spherical magnetic particles (e.g., see Japanese Patent Publication No. 3-9045).

Furthermore, as to a magnetic iron oxide for use in the magnetic toner, there are known magnetic particles comprising 1.7 to 4.5 atom % of silicon in terms of Si to iron and a magnetic iron oxide containing, as a metal element other than iron, 0 to 10 atom % of one or more metal elements selected from the group consisting of Mn, Zn, Ni, Cu, Al and Ti to iron (e.g., see Japanese Patent Application Laid-Open Nos. 9-59024 and 9-59025). When such magnetic particles are used, magnetic properties and charging properties of the magnetic toner are improved. However, when the above-described metals are simply added, both the developing properties and the image quality in a high-speed developing system are not simultaneously sufficiently satisfied, and room for improvement is left.

Furthermore, there are known magnetic particles which contain a silicon component continuously from centers to surfaces of the magnetic particles and in which the silicon components are exposed on the surfaces of the particles and the particles are coated with a metal compound having at least one metal element selected from the group consisting of Zn, Mn, Cu, Ni, Co, Cr, Cd, Al, Sn, Mg and Ti bonded to the silicon component (e.g., see Japanese Patent Application Laid-Open No. 11-157843). However, when such magnetic particles are used for a long term especially in the high-speed developing system, the deterioration of the image quality and the developing properties cannot be restrained, and therefore the above technique has respects, which should be further improved.

There are known magnetic particles which regulate a content of one or more metal elements selected from the group consisting of Mn, Zn, Ni, Cu, Co, Cr, Cd, Al, Sn and Mg on the basis of iron element, a content of silicon element, a content ratio of silicon element, existing up to an iron element solubility of 20 mass %, and a content ratio of the silicon element, existing up to an iron element solubility of 10% (e.g., see Japanese Patent Application Laid-Open Nos. 11-316474, 11-249335, and 11-282201). According to such magnetic particles, various metals are contained in a magnetic iron oxide, and distribution of silicon in the magnetic particles is regulated, whereby an improved environmentally stabilized effect is obtained. With regard to durability in the high-speed developing system, however, further improvement is required.

Moreover, there are known magnetic particles in which a silicon component is continuously exposed from centers to surfaces of the magnetic particles and whose shells are coated with a metal compound having at least one metal atom selected from the group consisting of Zn, Mn, Cu, Ni, Co, Cr, Cd, Al, Sn, Mg and Ti bonded to the silicon component and an aluminum component (e.g., see Japanese Patent Application Laid-Open No. 11-189420). In a magnetic toner having the magnetic particles, electric resistance and aggregation are satisfactory, however, saturated susceptibility remarkably deteriorates due to the increase of the silicon and aluminum components exposed on the surfaces of the magnetic particles, and a sufficient charging stability is not provided for the magnetic toner yet. Thus, a problem to be solved resides in a change of magnetic properties which depend on the thickness of a coating film of the magnetic particles.

Furthermore, there are proposed magnetic particles containing magnesium (e.g., see Japanese Patent Application Laid-Open No. 6-144840); magnetic particles containing aluminum and silicon (see Japanese Patent Application Laid-Open Nos. 5-72801, 5-213620, 7-175262, 7-239571, 7-110598, and 11-153882); magnetic particles containing zinc (e.g., see Japanese Patent Application Laid-Open Nos. 8-50369, 8-101529, 7-175262, 8-48524, 8-208236, and 8-208237); and magnetic particles containing silicon and other elements (e.g., see Japanese Patent Application Laid-Open Nos. 11-157843, 11-189420, and 11-316474).

When the magnetic toners containing the above-described elements are used, satisfactory developing properties are obtained. However, there are demands for further improvements in the developing properties and the durability in a case where the toner is applied to a developing system at a high speed or a developing system having a simple constitution. Specifically, there is further room for improvement concerning various problems caused by fluidity or charging properties of the magnetic toner, such as sleeve blotch, image scattering, and ghost, or the drop of the developing properties by a temperature rise in a machine.

Moreover, there are known magnetic particles characterized by a hexahedron or octahedron shape, in which a layer containing many silicon elements is formed on a nucleus surface formed by an iron atom uniformly mixed with a bivalent metal atom selected from the group consisting of Zn, Mg, and Mn (e.g., is see Japanese Patent Application Laid-open No. 8-50369). As to a magnetic toner using the magnetic particles, there is not any fog from a low-speed copying machine to a high-speed copying machine, and a high-density copied image is obtained. The toner is not influenced by any environmental fluctuation, and is superior in durability. However, there has not been any improvement from a viewpoint of retention of blackness or reduction of consumption.

As described above, the magnetic particles for use in the magnetic toner have not been improved in order to obtain a superior charged amount, retain the environmental stability, and suppress image defects such as blackness and ghost. In present situation, there is also left room for study concerning the reduction of the consumption of the toner formed from the magnetic particles.

SUMMARY OF THE INVENTION

An object of the present invention is to provide a magnetic toner containing magnetic particles, which solves the above-described problems.

That is, when magnetic particles are used in a magnetic toner, an object of the present invention is to provide a magnetic toner wherein an image obtained by oxidation of the magnetic particles does not become reddish and which stably has an optimum charged amount regardless of environment by use of magnetic particles having large charged amounts as materials of the magnetic toner and from which an image having a satisfactory ghost level can be obtained.

The present inventors have focused on physical properties of the magnetic particles contained in the magnetic toner, and have found that an image superior in a uniformly charging properties and an image quality can be stably formed for a long time while inhibiting generation of ghost, when magnetic particles having isoelectric points are contained in the toner. The present invention has been developed.

That is, the present invention relates to a magnetic toner comprising magnetic toner particles including at least a binder resin and magnetic particles, wherein the magnetic particles have an isoelectric point of pH 4.0 or less.

DETAILED DESCRIPTION OF THE INVENTION

The present inventors have investigated constituent materials of a magnetic toner, and as a result, they have found that especially an isoelectric point, an adsorbed moisture amount, and retentions before and after a thermal treatment of magnetic particles are closely related to developing properties, environmental stability and image quality of the magnetic toner.

That is, the present inventors have found that by a magnetic toner containing at least a binder resin and magnetic particles, and having a magnetic particle isoelectric point of pH 4.0 or less, rising of a charged amount is enhanced, a high image quality is stably obtained even by use under high/low humidity, and any image defect is not generated with an elapse of time.

As to the magnetic particles for use in the present invention, the isoelectric point is pH 4.0 or less, preferably pH 3.5 or less, more preferably pH 3.0 or less. That is, they are magnetic particles in an acid region. The magnetic particles, having pH 4.0 or less, that is, located in the acid region, generally exhibit satisfactory tendencies in a dispersibility into the binder resin and binding properties with respect to the binder resin. Especially, when the magnetic particles are used together with the binder resin whose isoelectric point is in the acid region, the above-described tendencies are more satisfactorily exhibited. The smaller a difference between the isoelectric points of the magnetic particles and that of the binder resin is, the more satisfactory the dispersibility and the binding properties become. To develop images having large printing areas continuously, when a subsequent image is developed, the magnetic toner is non-uniformly charged, and there is a fluctuation in distribution of the charged amount. In this case, the magnetic toner supplied onto a developing sleeve is not sufficiently charged. As a result, an image density of the subsequent image drops, and a concentration difference is made in the image. A so-called ghost image is sometimes generated. By uniform dispersion of the magnetic particles into the binder resin, the magnetic toner having a non-uniform charged amount decreases, and a ghost phenomenon can be effectively inhibited.

That is, in the present invention, since the isoelectric point of the magnetic particle is pH 4.0 or less, it is possible to improve the binding properties between the magnetic particles and the binder resin, and the dispersibility of the magnetic particles into the binder resin. Since the charged amount of the magnetic toner is kept at an appropriate value, the ghost phenomenon can be inhibited. It is to be noted that in the present invention, when a coating layer is formed on the surfaces of the magnetic particles by a exemplary method described later, the isoelectric points of the magnetic particles can be adjusted into pH 4.0 or less.

The isoelectric points of the magnetic particles and the binder resin are measured by the following method.

First, the magnetic particles are dissolved or dispersed in ion exchange water at 25° C. in such a manner as to adjust a sample concentration into 1.8 mass %. A zeta potential is measured by titration with 1N-HCl using an ultrasonic zeta potential analyzer DT-1200 (manufactured by Dispersion Technology Co.). In the present invention, pH at a point where the zeta potential was 0 mV was assumed as an isoelectric point. With regard to the binder resin, the isoelectric point was measured in the same manner as in the magnetic particles except that the resin was filtered through a sieve having 60 meshes (opening diameter of 250 μm), and used as the sample.

The magnetic particles for use in the present invention preferably contain, in the surfaces, 0.8 to 20.0 mass %, further preferably 1.0 to 5.0 mass % of $SiO_2$ with respect to a total amount of magnetic particles. When $SiO_2$ exists in the magnetic particle surfaces, it is possible to prevent a fluidity defect caused by aggregation, which is regarded as a problem in the magnetic particles having small particle size. Due to the presence of $SiO_2$, which is a nonmagnetic inorganic compound, on the magnetic particle surfaces, an electric resistance value of the magnetic toner rises, and a high charged amount can be retained independent of the environment. Since the charged amount can be retained even under strict environments such as under low temperature/humidity, a loaded amount of the magnetic toner can be held to be constant, and hence, it is possible to reduce consumption of the magnetic toner.

When a content of $SiO_2$ existing on the magnetic particle surfaces is less than 0.8 mass % with respect to the total amount of the magnetic particles, the magnetic particle surfaces are not uniformly or sufficiently coated with $SiO_2$. Therefore, when the magnetic particles are used in the magnetic toner, a sufficient charged amount cannot be provided for the magnetic toner, and an image density is sometimes lowered. When the content of $SiO_2$ is less than 0.8 mass %, an effect of improving the fluidity of a powder sometimes drops. On the other hand, when the content of $SiO_2$ is larger than 20.0 mass %, the charged amount of the magnetic toner is excessively high. Therefore, the drop of the density or an increase of fog is sometimes incurred by charge-up.

That is, in the present invention, when the magnetic particles contain, in the surfaces, 0.8 to 20.0 mass % of $SiO_2$ with respect to the total amount of the magnetic particles, the magnetic particle surfaces are uniformly and sufficiently coated with $SiO_2$, and surface properties close to $SiO_2$ are provided for the surfaces of the magnetic particles, and the charged amount can be enhanced/retained. As a result, the consumption of the magnetic toner can be reduced, while retaining a satisfactory fluidity, and developing properties at high image density and high quality regardless of the environment.

It is to be noted that the content of $SiO_2$ in the magnetic particle surfaces was measured by performing fluorescence X-ray analysis according to JIS K0119 "Fluorescence X-Ray Analysis General Rule" using a fluorescence X-ray analyzer SYSTEM 3080 (manufactured by Rigaku Denki Kogyosha).

Specifically, the contents of $SiO_2$ in the magnetic particle having the coating layer thereon and in the magnetic particle (core-material magnetic particle) before forming the coating layer were measured using the fluorescence X-ray analyzer, and the content of $SiO_2$ in the magnetic particle (core-material magnetic particle) before forming the coating layer was subtracted from that of $SiO_2$ in the magnetic particle having the coating layer thereon to obtain the content of $SiO_2$ in the magnetic particle surface in the present invention.

The magnetic particles for use in the present invention have, on the surfaces, a coating layer including $SiO_2$, and an adsorbed moisture amount at a relative vapor pressure of 50% is 1 to 100 mass %, preferably 1 to 20 mass % with respect to $SiO_2$ in the coating layer per unit mass.

The surfaces of the magnetic particles having a small amount of adsorbed moisture are not easily oxidized by contact with moisture in the air. The oxidation of the magnetic particle surfaces is inhibited, which has been regarded as a problem especially in the small-particle size magnetic particles having an enlarged surface area, and hence, the extent of blackness is retained. The reduction of the amount of adsorbed moisture is achieved, when the magnetic particles are coated with the dense coating layer of $SiO_2$. Due to the coating layer of $SiO_2$, which is a dense nonmagnetic inorganic compound, the electric resistances of the magnetic particles increase, and a high charged amount can be retained.

That is, in the present invention, when the magnetic particles are used in the magnetic toner, and the amount of adsorbed moisture of the magnetic particles at a relative vapor pressure of 50% is in a range of 1 to 100 mass % with respect to an coating $SiO_2$ amount per unit mass, an image having high blackness can be obtained. Since the magnetic toner retains a desired large charged amount, it is possible to reduce the consumption of the magnetic toner.

The adsorbed moisture amount in the present invention is measured by an adsorption equilibrium measurement device (EAM-02; manufactured by JT Toshi Kabushiki Kaisha). This device reaches solid-gas equilibrium under a condition that an only gas (water vapor in the present invention) exists as an object, and measures a solid mass and a vapor pressure at this time.

All of actual measurements including from the following measurement of a dry mass and deaeration of dissolved air in water to measurement of the adsorption/desorption isothermal curve are automatically performed by a computer. An outline of the measurement is described in an operation manual issued by JT Toshi Kabushiki Kaisha. A specific measurement method is as follows.

First, after charging a sample container in an adsorption tube with about 5 g of the magnetic toner, a constant-temperature bath temperature and a sample portion temperature are set at 28° C. Thereafter, a main valve V1 and an ventilation valve V2 are opened, an evacuation section is operated, and vacuum container is evacuated at about 0.01 mmHg, and the sample is dried. A mass at a time when a weight reduction of the sample is not observed is referred to as "a dry mass".

On the other hand, since the air is dissolved in a solvent solution (water in the present invention), the deaeration needs to be performed. First, the solvent solution (hereinafter referred to as "water") is poured in a solution reservoir, the evacuation section is operated, the ventilation valve V2 is closed, and a solution reservoir valve V3 is opened to remove the dissolved air. The above-described operation is repeated several times, and a time when any bubble is not observed in water is regarded as end of the deaeration.

Following the measurement of the dry mass, and the deaeration of the dissolved air in water, the inside of the sample container is retained under vacuum, the main valve V1 and the ventilation valve V2 are closed, and the solution reservoir valve V3 is opened. Accordingly, the vapor is introduced from the solution reservoir, and the solution reservoir valve V3 is closed. Subsequently, when the main valve V1 is opened, the vapor is introduced into the sample container, and the pressure is measured by a pressure sensor. When the pressure in the sample container does not reach a set pressure, the above-described operation is repeated to thereby regulate the pressure in the sample container to a set pressure. When reaching the equilibrium, the pressure and the mass are constant in the sample container. Therefore, the pressure, the temperature, and the sample mass at this time are measured as equilibrium data.

In the present device, the pressure is set using the relative vapor pressure (%), and the adsorption/desorption isothermal curve is represented by the adsorbed amount (%) and the relative vapor pressure (%). Calculation equations of the adsorbed amount and the relative vapor pressure are as follows:

$$M=(Wk-Wc)/Wc\times 100 \quad (1);$$

and $$Pk=Q/Q0\times 100 \quad (2),$$

wherein M denotes an adsorbed amount [%]; Pk denotes a relative vapor pressure [%]; Wk denotes a sample mass [mg] at an adsorption time; Wc denotes a dry mass [mg] of the sample; Q0 denotes a saturated vapor pressure [mmHg] of water obtained by Antoine equation from a temperature Tk [°

C.] at an adsorption/description equilibrium time; and Q denotes a pressure [mmHg] measured as the equilibrium data, respectively.

Furthermore, the magnetic particles for use in the present invention have, on the surfaces, the coating layer including $SiO_2$, and contain 17 mass % or more of $Fe^{2+}$ before the thermal treatment. When the thermal treatment is performed in the air at 160° C. for one hour, retention of $Fe^{2+}$ is preferably 60% or more, further preferably 70% or more.

The use of the magnetic particles containing 17 mass % or more of $Fe^{2+}$ before the thermal treatment is more effective from a viewpoint that the magnetic particles have a sufficient blackness and magnetic properties. That is, as to the magnetic particles having a high retention of $Fe^{2+}$ before/after the thermal treatment, the surfaces of the particles are not easily oxidized in the air. Therefore, it is possible to retain the extent of blackness, which is regarded as a problem especially in the magnetic particles having small particle size. Since the particles are coated with the dense coating layer including $SiO_2$ that is the nonmagnetic inorganic compound, it is possible to raise the electric resistances of the magnetic particles, and retain the large charged amount. Especially, the magnetic particles exposed on the surface of the magnetic toner may be leak sites during the charging, but the magnetic particles having the coating layer including $SiO_2$ have high electric resistances by the dense coating layer, and it is therefore possible to retain the charged amount of the magnetic toner. Since the magnetic particles are coated with the dense coating layer by $SiO_2$, the magnetic particles are superior in fluidity and dispersion, and reduction of the particle size of the magnetic toner can be achieved. As a result, since the desired charged amount is maintained regardless of the environment, and a load amount of the magnetic toner is held to be constant, it is possible to achieve the high image quality superior in stability and the reduction of the consumption of the magnetic toner.

A change of a content of bivalent iron ($Fe^{2+}$) before/after the thermal treatment of the magnetic particles is measured by the following method.

First, the magnetic particles are dissolved in sulfuric acid, oxidation-reduction titration is performed using a potassium permanganate standard solution, and the content of $Fe^{2+}$ in the magnetic particles before the thermal treatment is measured. On the other hand, 0.500 g of magnetic particle sample, thermally treated at 160° C. for one hour, is precisely weighed, and taken into a 500 ml triangular flask, and 10 ml of concentrated hydrochloric acid is added. The flask is sealed with a rubber stopper permeable to a gas, and heated while passing through a carbon dioxide gas to decompose the sample completely. After cooling the flask at room temperature while still passing through the carbon dioxide gas, the rubber stopper is cleaned with pure water in such a manner that a cleaning solution enters the triangular flask, and the cleaning solution is diluted into 150 ml with the pure water. Subsequently, the titration is performed using a potential difference titration device with 0.1 N potassium permanganate standard solution to measure the content of $Fe^{2+}$ in the thermally treated magnetic particles. In the present invention, the retention of $Fe^{2+}$ is obtained as a percentage of the content of $Fe^{2+}$ after the thermal treatment with respect to that of $Fe^{2+}$ before the thermal treatment in the magnetic particles.

In the present invention, the content and the retention of $Fe^{2+}$ in the magnetic particles can be adjusted, for example, by appropriate selecting and/or controlling of the types of the magnetic particles, type and blended amount of a nonmagnetic material blended with the magnetic particles, or type and coating amount or coating state of a material for coating the magnetic particles.

Furthermore, the magnetic particles for use in the present invention preferably have an average particle size of 0.08 to 0.25 μm in respect of the dispersion of the magnetic particles into the binder resin, the blackness, and the magnetic properties. When the average particle size of the magnetic particles is less than 0.08 μm, a dispersion defect is sometimes unfavorably caused by re-aggregation of the magnetic particles in the magnetic toner. When the average particle size of the magnetic particles is larger than 0.25 μm, the diameter is advantageous in terms of the blackness, but the dispersibility of the magnetic particles in the magnetic toner is sometimes unfavorably deteriorated.

The average particle size of the magnetic particles is measured by the following method. By use of a photograph (magnification of 30,000 times) of the magnetic particles taken by a transmission electron microscope (H-7500; manufactured by Hitachi, Ltd), 100 particles on the photograph are selected at random, maximum lengths of the individual magnetic particles are measured, and an average value of the maximum lengths is obtained as the average particle size. For example, in a method of preparing the magnetic particles as described later, the average particle size of the magnetic particles can be adjusted by the controlling of a particle production process by initial alkali concentration or oxidative reaction.

In the magnetic particles for use in the present invention, as the magnetic properties in a magnetic field of 795.8 kA/m, a saturated susceptibility is in a range of 10 to 200 $Am^2/kg$, further preferably 70 to 100 $Am^2/kg$, a residual susceptibility is in a range of 1 to 100 $Am^2/kg$, further preferably 2 to 20 $Am^2/kg$, and an coercive force is in a range of 1 to 30 kA/m, further preferably 2 to 15 kA/m. The magnetic particles preferably have these magnetic properties from a view point that the magnetic toner obtains satisfactory developing properties while the image density and the fog are well balanced. The magnetic properties of a magnetic material can be measured using "vibration sample type magnetometer VSM-3S-15" (manufactured by Toei Industry Co., Ltd.) under an external magnetic field of 795.8 kA/m.

A specific material to be used in the magnetic particles for use in the present invention, and a method of preparing the particles will be described hereinafter. The magnetic particles for use in the present invention comprise magnetic particles which are core particles, and a coating layer of $SiO_2$ formed on the surfaces of the magnetic particles if necessary. To distinguish the magnetic particles including the coating layer from the magnetic particles which do not have any coating layer, the magnetic particles which do not have any coating layer (before forming the coating layer) will be hereinafter referred to as "the core magnetic particles". That is, the magnetic particles for use in the present invention may comprise core magnetic particles only, or the core magnetic particles and the coating layer. The magnetic particles including the core magnetic particles and the coating layer correspond to a preferable mode in the present invention.

As the core magnetic particles in the present invention, any of a magnetic iron oxide containing heterologous elements such as magnetite, maghemite, and ferrite, and a mixture of them is usable, and magnetite having a large content of FeO is preferably a main component. In general, magnetite particles are obtained by oxidizing of ferrous hydroxide slurry obtained by neutralizing/mixing of a ferrous salt aqueous solution and an alkali solution.

Moreover, the core magnetic particles for use in the present invention are preferably magnetic iron oxide particles containing the heterologous elements, more preferably magnetic iron oxide particles containing a Si element as the heterologous element. The Si elements preferably exist in both of the inside and the surface of the core magnetic particle. When the Si elements are added in a stepwise manner in the process of preparing the core magnetic particles, the Si element more preferably exist preferentially on the surface. When the core magnetic particles contain the Si elements in the surfaces thereof, a large number of pores are easily generated in the surfaces. Furthermore, when the coating layer including $SiO_2$ is formed on a shell of the particle, a bonding force is enhanced between the core magnetic particle surfaces and $SiO_2$, and a dense coating layer can be formed.

A content of the Si element is in a range of preferably 0.1 to 3.0 mass %, more preferably 0.1 to 2.0 mass % with respect to Fe element in the core magnetic particle. When the content of the Si element is less than 0.1 mass %, the bonding force tends to become insufficient with a silicate compound forming the coating layer. On the other hand, when the content is larger than 3.0 mass %, denseness of the coating layer, formed on the surfaces of the core magnetic particles, is impaired, and the smoothness of the coated magnetic particles is easily lost.

As to the magnetic particles for use in the present invention, after obtaining the core magnetic particles using a general method of preparing the magnetic particles, the $SiO_2$-containing coating layer is formed on the surfaces of the core magnetic particles in such a manner as to adjust the isoelectric point, the adsorbed moisture amount, and the retention of $Fe^{2+}$ after the thermal treatment into the above-described ranges to thereby obtain the magnetic particles.

The core magnetic particles before forming the coating layer containing $SiO_2$ do not have any special problem even by use of a known method of preparing the magnetic particles, and the core magnetic particles preferentially containing the Si element in the surface thereof, which are preferable in the present invention, are prepared, for example, by the following method.

An aqueous ferrous salt solution is allowed to react with an aqueous alkali hydroxide solution having an equivalent weight of 0.90 to 0.99 with respect to $Fe^{2+}$ in the aqueous ferrous salt solution to thereby obtain a reacted aqueous ferrous salt solution containing ferrous hydroxide colloid. Here, water-soluble silicate is added beforehand to either of the aqueous alkali hydroxide solution and the reacted ferrous salt solution containing ferrous hydroxide colloid in a range of 50 to 99% of a total content (0.1 to 3.0 mass %) in terms of the Si element with respect to the iron element. Moreover, while the reacted aqueous ferrous salt solution containing the ferrous hydroxide colloid is heated at a temperature ranged from 85 to 100° C., an oxygen-containing gas (e.g., air) is passed to cause the oxidative reaction. Consequently, core magnetic nucleus crystal particles containing Si elements are produced from the ferrous hydroxide colloid. In this case, the oxidative reaction is preferably performed on a condition of pH 6.0 to 7.0. Thereafter, after adding an aqueous alkali hydroxide solution having an equivalent weight of 1.00 or more with respect to $Fe^{2+}$ remaining in a suspension after the end of the oxidative reaction, and remaining water-soluble silicate [1 to 50% of a total content (0.4 to 2.0 mass %)], further heating is performed at a temperature ranged from 85 to 100° C. to cause the oxidative reaction. In this case, the oxidative reaction is preferably performed on a condition of pH 8.0 to 10.5. Next, filtering, washing, drying, and grinding are performed by a known method, and accordingly the core magnetic particles are obtained according to the present invention. Furthermore, as a method of adjusting the average particle size, the smoothness, and specific surface areas of the core magnetic particles into preferable ranges, the core magnetic particles are preferably compressed, sheared, and flatted with a spatula using a mix muller, a stone mill or the like.

Examples of the silicate compound to be added to the core magnetic particles for use in the present invention include silicate salts such as commercially available silicate soda, and silicate such as sol silicate generated by hydrolysis or the like.

Furthermore, as the ferrous salt, in general, it is possible to use ferrous sulfate which is a by-product in preparing titanium in a sulfuric acid process, or ferrous sulfate which is a by-product in cleaning the surface of a steel plate. Furthermore, iron chloride or the like is usable.

In observation by a transmission type electron microscopic photograph, the core magnetic particles prepared by the above-described preparation method include spherical particles formed mainly by curved surfaces, which do not include any plate-like surface. The magnetic particles including the spherical particles and hardly including octahedron particles are produced. The magnetic particles are preferably used in the magnetic toner.

On the other hand, in the magnetic particles for use in the present invention, a total content of Al, P, S, Cr, Mn, Co, Ni, Cu, Zn, and Mg is preferably small. The above-described components are contained as inevitable components derived from raw materials at the time of the preparation of the magnetic particles. In the magnetic particles for use in the present invention, when the maintenance of the blackness and the magnetic properties are considered, the total content is preferably 1 mass % or less with respect to the mass of the magnetic particles, because the smaller total content of the components exerts more effects.

It is to be noted that in the above-described magnetic particles, Si may be incorporated in an iron oxide crystal lattice, or Si may be incorporated in iron oxide. In a more preferable mode for achieving the object of the present invention, Si is present in the form of oxide on the surfaces of the magnetic particles as described above. Especially, when the core magnetic particles are coated with $SiO_2$ in the following method, the effect of the present invention can be maximized.

Aqueous suspension, containing the core magnetic particles at a concentration of 50 to 200 g/l, is held at 60 to 80° C. An aqueous sodium hydroxide solution is added, and pH of the aqueous suspension is set to 9.0. While the aqueous suspension is stirred, 0.1 to 10.0 mass % of an aqueous sodium silicate solution is added in terms of $SiO_2/Fe_3O_4$. Next, a diluted sulfuric acid is added to the aqueous suspension to lower pH of the suspension gradually, and the aqueous suspension is finally neutralized in about four hours. When the suspension is cleaned, filtered, dried, and crushed, the magnetic particles coated with $SiO_2$ can be obtained.

Moreover, to use the magnetic particles coated with $SiO_2$, the average particle size of the core magnetic particles is set to 0.25 μm or less, more preferably 0.10 to 0.25 μm in consideration of the dispersing properties of the particles in the binder resin, and uniformity in charging the magnetic toner. The average particle size of the core magnetic particles is measured in the same manner as in the measurement of the average particle size of the magnetic particles.

Moreover, in the magnetic toner of the present invention, preferably 50 to 150 parts by mass, more preferably 60 to 120 parts by mass of the magnetic particles are used with respect to 100 parts by mass of the binder resin. When the content of the magnetic particles is less than 50 parts by mass, image fogging or scattering is deteriorated, and further a coloring force is unfavorably insufficient in some case. When the content is larger than 150 parts by mass, the magnetic toner does not sufficiently fly from a charge-providing member (developing sleeve). This is unfavorably a cause of a drop in image density in some case.

The magnetic toner of the present invention includes at least the binder resin in addition to the magnetic particles.

An isoelectric point of the binder resin is preferably pH 2.0 to 4.0. A difference between the isoelectric points of the magnetic particles and the binder resin is preferably small. Assuming that the isoelectric point of the magnetic particles is X, and that of the binder resin is Y, a difference (X−Y) between the isoelectric points of the magnetic particles and the binder resin preferably satisfies the following equation (i):

$$-2.0 \leqq (X-Y) \leqq 2.0 \quad \text{(i).}$$

When the isoelectric points of the magnetic particle and the binder resin satisfy the above equation (i), the dispersing properties of the magnetic particles in the binder resin, and adhesiveness between the binder resin and the magnetic particles become more satisfactory. Therefore, the magnetic toner having a non-uniform charged amount decreases, and the ghost phenomenon can be effectively inhibited.

As the binder resin for use in the present invention, various resins are usable which have heretofore been known as the binder resins. Examples of the binder resin include a vinyl-based resin, a phenol resin, a natural resin modified phenol resin, a natural resin modified maleic acid resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a coumaroindene resin, and a petroleum-based resin. Especially, the binder resin is preferably a resin having at least a polyester unit. It is to be noted that, in the present invention, "the polyester unit" indicates a portion derived from polyester. That is, "the resin having the polyester unit" in the present invention indicates a resin having a repeated unit including at least an ester bond.

When the resin has the polyester unit obtained from acid and alcohol components, the resin has an isoelectric point equal to that of the magnetic particles in the present invention. The resin has superior mixing properties with the magnetic particles, and is not easily detached. The resin is especially preferable in binding properties.

Furthermore, in the present invention, as to the resin having the polyester unit preferably for use, all components include 45 to 55 mol % of alcohol components, and 55 to 45 mol % of acid components.

As the alcohol component, there may be mentioned polyhydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following general formula (B), diols represented by the following general formula (C), glycerin, sorbit, and sorbitan.

(B)

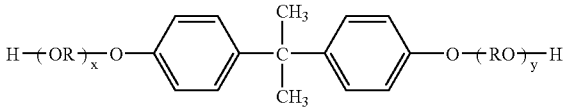

wherein R denotes an ethylene or propylene group, x and y are integers of 1 or more, respectively, and an average value of x+y is 2 to 10.

(C)

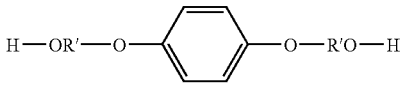

wherein R' denotes

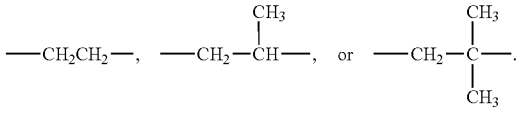

Moreover, as the acid component, carboxylic acids can be preferably exemplified. As bivalent carboxylic acids, there may be mentioned benzenedicarboxylic acids or anhydrides thereof such as phthalic acid, terephthalic acid, isophthalic acid, and phthalic anhydride; alkyldicarboxylic acids or anhydrides thereof such as succinic acid, adipic acid, sebacic acid, azelaic acid; unsaturated dicarboxylic acids or anhydrides thereof such as fumaric acid, maleic acid, citraconic acid, itaconic acid. Moreover, as tri- or higher valent carboxylic acids, there may be mentioned trimellitic acid, pyromellitic acid, benzophenonetetracarboxylic acid, or anhydrides thereof.

As a particularly preferable alcoholic component of the polyester resin, there may be mentioned bisphenol derivatives represented by the above formula (B). As the acid component, there may be mentioned dicarboxylic acids such as phthalic acid, terephthalic acid, isophthalic acid, or anhydrides thereof, succinic acid, n-dodecenylsuccinic acid, or anhydrides thereof, fumaric acid, maleic acid, maleic anhydride; and tricarboxylic acids such as trimellitic acid or anhydride thereof. The magnetic toners using the polyester resins obtained from these acid components and alcohol components as binder resins have isoelectric points nearly equal to the isoelectric point of the magnetic particles in the invention, are good in fixability, and are excellent in offset resistance.

In the invention, in addition to the resins having polyester units, the following vinyl resins may be used as the binder resins.

As the vinyl resins, there may be mentioned, for example, vinyl polymers using vinyl monomers, e.g., styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-dodecylstyrene, and p-n-dodecylstyrene; ethylenic unsaturated monoolefins such as ethylene, propylene, butylene, and isobutylene; unsaturated polyenes such as butadiene; halogenated vinyls such as vinyl chloride, vinylidene chloride, vinyl bromide, and vinyl fluoride; vinyl esters such as vinyl acetate, vinyl propionate, and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; acrylic or methacrylic acid derivatives such as acrylonitrile, methacrylonitrile, and acrylamide; α,β-unsaturated acid esters and dibasic acids diesters; acrylic acid and α- or β-alkyl derivatives thereof such as acrylic acid, methacrylic acid, α-ethylacrylic acid, crotonic acid, cinnamic acid, vinylacetic acid, isocrotonic acid, and angelic acid; unsaturated dicarboxylic acids such as fumaric acid, maleic acid, citraconic acid, alkenylsuccinic acid, itaconic acid, mesaconic acid, dimethylmaleic acid, and dimethylfumaric acid and monoester derivatives or anhydrides thereof. In the above vinyl resins, vinyl monomers as mentioned above may be used solely or as a mixture of two or more of them. Of these, combinations of monomers forming styrene polymers and styrene-acrylic copolymers are preferable.

There is not any special restriction as to a method of synthesizing the binder resin comprising a vinyl-based homopolymer or copolymer. It is possible to use various preparation methods which have heretofore been known, and polymerization methods are usable such as a bulk polymerization method, a solution polymerization method, a suspension polymerization method, and an emulsification polymerization method. When a carboxylic acid monomer or an acid anhydride monomer is used, the bulk polymerization method or the solution polymerization method is preferably utilized because of properties of the monomer.

Furthermore, the binder resin for use in the present invention may be a polymer or a copolymer which is, if necessary, cross-linked by a crosslinking monomer described hereinafter. As the crosslinking monomer, it is possible to use a monomer having two or more unsaturated bonds which can be cross-linked. As this type of crosslinking monomer, various monomers described hereinafter have heretofore been known, and can be preferably used in a developer in the present invention.

For the above croslinkable monomers, there may be mentioned, for example, divinylbenzene and divinylnaphthalene as aromatic divinyl compounds, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those wherein each acrylate of the above compounds is changed to methacrylate; for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those wherein each acrylate of the above compounds is changed to methacrylate, as diacrylate compounds bonded with an alkyl chain containing an ether bond; for example, polyoxyethylene(2)-2,2-bis(4-hydroxyphenyl)propane diacrylate, polyoxyethylene(4)-2,2-bis(4-hydroxyphenyl)propane diacrylate, and those wherein each acrylate of the above compounds is changed to methacrylate, as diacrylate compounds bonded with a chain containing an aromatic group and an ether bond; for example, trade name MANDA (Nippon Kayaku Co., Ltd.) as polyester-type diacrylates; and the like.

As the polyfunctional crosslinking agent, there may be mentioned pentaerythritol triacrylate, trimethylolethane triacrylate, trimethylolpropane triacrylate, tetramethylolmethane tetraacrylate, oligoester acrylates, and those wherein each acrylate of the above compounds is changed to methacrylate; triallyl cyanurate, triallyl trimellitate, and the like.

Among the above-described crosslinking monomers, in respect of fixing properties or resistance to offset of the resultant magnetic toner, examples of the monomer preferable for use in the binder resin include an aromatic divinyl compound (especially divinyl benzene), and a diacrylate compound bonded via chains including an aromatic group and an ether bond.

Moreover, a use amount of the crosslinking agent is preferably adjusted by a type of monomer to be cross-linked, physical properties required in the binder resin and the like. In general, 0.01 to 10.00 parts by mass (more preferably 0.03 to 5.00 parts by mass) of the agent can be used with respect to 100 parts by mass of another monomer component constituting the binder resin.

In the present invention, if necessary, the above-described binder resin can be mixed and used with a homopolymer or a copolymer of a vinyl-based monomer other than the above-described monomer, polyester, polyurethane, epoxy resin, polyvinyl butyral, rosin, modified rosin, terpene resin, phenol resin, aliphatic or alicyclic hydrocarbon resin, aromatic petroleum resin or the like. When two or more types of resins are mixed and used as the binder resin, resins having different molecular weights are more preferably mixed at an appropriate ratio.

Moreover, in the present invention, when the binder resin contains a hybrid resin component allowed to react partially with at least both of the polyester resin and the vinyl-based resin, a targeted effect of the present invention can be preferably obtained. In the hybrid resin, two types of resins which are not originally easily soluble to each other are uniformly dispersed. Therefore, properties of both of the resins can be utilized such as charging properties, fixing properties, and storage stability. Additionally, the hybrid resin is also superior in mutual solubility to another internal additive.

In the present invention, the binder resin for use in the magnetic toner preferably has an acid value. The acid value of the binder resin is preferably 1 to 50 mgKOH/g, more preferably 4 to 40 mgKOH/g.

As a result of investigation, the present inventors have found that the charged amount or the charging stability of the magnetic toner is not little influenced by a charged amount distribution on the surface of the magnetic toner. When there is unevenness in the charged amount distribution, the surface locally constitutes a leak site of the electric charge, or the surface is charged up, and accordingly the charging stability of the magnetic toner is easily impaired. Furthermore, by use of the binder resin whose acid value is in the above-described range, a difference in adsorbed moisture amount can be reduced between a magnetic particle portion exposed on the surface of the magnetic toner, and a binder resin portion other than the magnetic particle portion. Therefore, the charged amount distribution of the magnetic toner surface can be uniformed.

When the acid value of the binder resin is less than 1 mgKOH/g, or exceeds 50 mgKOH/g, it is difficult to control the adsorbed moisture amount of the magnetic toner. Additionally, there is a tendency to increase environmental fluctuations of the charging properties of the magnetic toner.

Moreover, a hydroxyl group value (OH value) of the binder resin is preferably 60 mgKOH/g or less, more preferably 45 mgKOH/g or less. This is because dependence of the charging properties of the magnetic toner on the environment increases with an increase of the number of terminal groups of molecular chains. There occur fluctuations in magnetic toner fluidity, electrostatic adhering properties, and developer surface resistance (influence of adsorbed water), and an image quality drops in some case.

It is to be noted that the acid value is obtained by the following steps 1) to 5). Basic steps conform to JIS K 0070.

1) As to a sample, the additives other than the binder resin (polymer component) are removed beforehand from the sample for use, or the acid value of the component other than the binder resin of the sample is obtained beforehand. A crushed magnetic toner or binder resin is precisely weighed in a range of 0.5 to 2.0 (g). In this case, a binder resin component is assumed as W (g).

2) The sample is placed in a 300 (ml) beaker, and 150 (ml) of a mixed solution of toluene and ethanol (mass of toluene/mass of ethanol=4/1) is added to the sample to dissolve the sample.

3) An amount of the sample is measured using an ethanol solution containing 0.1 (mol/l) KOH, and using a potential difference titration measurement device. In this titration, automatic titration can be utilized using, for example, the potential difference titration measurement device AT-400 (winwokstation) and ABP-410 electromotive buret manufactured by Kyoto Denshi Kabushiki Kaisha.

4) In this case, it is assumed that the use amount of the KOH ethanol solution is S (ml). Moreover, the amount of a blank is measured, and the use amount of the KOH ethanol solution at this time is assumed as B (ml).

5) The acid value is calculated by the following equation. It is to be noted that, in the equation, f denotes a factor of KOH:

$$\text{acid value (mg}KOH\text{/g)}=\{(S-B)\times f\times 5.61\}/W.$$

Furthermore, the OH value is obtained by the following steps 1) to 8). Basic steps conform to JIS K 0070.

1) As to a sample, the additives other than the binder resin (polymer component) are removed beforehand from the sample for use, or the content of the component other than the binder resin of the sample is obtained beforehand. A crushed magnetic toner or binder resin is precisely weighed in a range of 0.5 to 2.0 (g) in a 200 (ml) flat-bottom flask.

2) Subsequently, 5 ml of an acetylation reagent is added (25 g of acetic anhydride is taken into a flask having a total capacity of 100 ml, pyridine is added to obtain a total amount of 100 ml, and the sample is sufficiently stirred). It is to be noted that when the sample is not easily dissolved, a small amount of pyridine is added, or xylene or toluene is added to dissolve the sample.

3) A small funnel is laid on a mouth of the flask, and an about 1 cm bottom portion of the flask is submerged and heated in glycerin bath at a temperature of 95 to 100° C. A root of a neck of the flask is covered with a thick paper disc having a round hole formed therein in order to prevent a temperature rise in the neck of the flask heated by the glycerin bath.

4) The flask is removed from the glycerin bath one hour later, and left to cool. Thereafter, 1 ml of water is added via the funnel, and the flask is vibrated to decompose the acetic anhydride.

5) Furthermore, to complete the decomposition, the flask is again heated in the glycerin bath for ten minutes. After the radiational cooling, the funnel and a flask wall are washed with 5 ml of ethanol.

6) Several drops of a phenolphthalein solution are added as an indicator, 0.5 kmol/$m^3$ of potassium hydroxide ethanol solution is titrated, and a time when the indicator continues to be thinly red for about 30 seconds is regarded as an end point.

7) The steps 2) to 6) are performed as a blank test without using any resin.

8) A hydroxyl group value (OH value) is calculated by the following equation:

$$\text{hydroxyl group value (mg}KOH\text{/g)}=[\{(D-E)\times 28.05\times f'\}/S]+F,$$

wherein D denotes a titrated amount (ml) of 0.5 kmol/$m^3$ of potassium hydroxide ethanol solution used in the blank test, E denotes a titrated amount (ml) of 0.5 kmol/$m^3$ of potassium hydroxide ethanol solution used in the titration; f' denotes a factor of 0.5 kmol/$m^3$ of potassium hydroxide ethanol solution; S denotes an amount (g) of the binder resin contained in the sample; and F denotes an acid value of the sample. It is to be noted that in the equation, "28.05" is a formula weight (56.11×½) of potassium hydroxide.

Furthermore, a glass-transition temperature of the binder resin for use in the present invention is preferably 45 to 80° C., more preferably 55 to 70° C. A number average molecular weight (Mn) of the binder resin is preferably 2,500 to 50,000, and a weight average molecular weight (Mw) of the binder resin is preferably 10,000 to 1,000,000.

The glass-transition temperature of the binder resin can be adjusted by selection of a material (polymeric monomer) constituting the binder resin in such a manner that a theoretical glass-transition temperature indicates 45 to 80° C. The temperature is described in Polymer Handbook 2nd edition III-P. 139 to 192 (published by John Wiley & Sons Co.). The glass-transition temperature of the binder resin can be measured in conformity to ASTM D3418-82, using a differential scanning calorimeter, for example, DSC-7 manufactured by Perkin Elmer Co. or DSC2920 manufactured by TA Instruments Japan Co. When the glass-transition temperature of the binder resin is lower than the above-described range, the storage stability of the magnetic toner is sometimes insufficient. When the glass-transition temperature of the binder resin is higher than the above-described range, the fixing properties of the developer are sometimes insufficient.

The magnetic toner of the invention may further contain a wax.

The waxes for use in the invention are as follows. For example, there may be mentioned aliphatic hydrocarbon-based waxes such as low-molecular-weight polyethylene, low-molecular-weight polypropylene, polyolefin copolymers, polyolefin waxes, microcrystalline waxes, paraffin waxes, and Fischer-Tropsch wax; oxidation products of aliphatic hydrocarbon-based waxes such as oxidized polyethylene waxes; or block copolymers thereof; vegetable waxes such as candelilla wax, carnauba wax, Japan wax, and jojoba wax; animal waxes such as beeswax, lanolin, and spermaceti; mineral waxes such as ozokerite, ceresin, and petrolatum; waxes containing aliphatic esters, such as montanic acid ester wax and caster wax; those obtainable by deoxidation of part or all of aliphatic esters, such as deoxidized carnauba wax. Furthermore, saturated linear aliphatic acids such as palmitic acid, stearic acid, montanic acid, and further long-chain alkylcarboxylic acids each having a long-chain alkyl group; unsaturated aliphatic acids such as brassidic acid, eleostearic acid, and valinaric acid; saturated alcohols such as stearyl alcohol, eicosyl alcohol, behenyl alcohol, carnaubyl alcohol, ceryl alcohol, melissyl alcohol, and further alkyl alcohols each having a long-chain alkyl group; polyhydric alcohols such as sorbitol; aliphatic amides such as linoleic amide, oleic amide, and lauric amide; saturated aliphatic bisamides such as methylenebisstearic amide, ethylenebiscapric amide, ethylenebislauric amide, and hexamethylenebisstearic amide; unsaturated aliphatic amides such as ethylenebisoleic amide, hexamethylenebisoleic amide, N,N'-dioleyladipic amide, and N,N'-dioleylsebacic amide; aromatic bisamides such as m-xylenebisstearic amide and N,N'-distearylisophthalic amide; aliphatic metal salts such as calcium stearate, calcium laurate, zinc stearate, and magnesium stearate (generally called metal soaps); waxes obtainable by grafting aliphatic hydrocarbon waxes with a vinyl monomer such as styrene or acrylic acid; partially esterified products of fatty acids with polyhydric alcohols, such as behenic acid monoglyceride;

methyl ester compounds each having a hydroxyl group obtainable by hydrogenation of vegetable oils and fats.

Furthermore, to use these waxes, a molecular weight distribution of the wax may be sharpened using a press sweating method, a solvent process, a re-crystallization process, a vacuum distillation process, a supercritical gas extraction process or a melt crystallization process. Alternatively, a low molecular weight solid fatty acid, a low molecular weight solid alcohol, a low molecular weight solid compound, or waxes in which impurities are removed may be preferably used.

As the wax for use in the present invention, a melting point is preferably 60 to 120° C., more preferably 70 to 110° C.

In a step of kneading the magnetic particles, the binder resin, and the wax, the magnetic particles are oxidized because a kneading temperature rises, and this sometimes causes reddishness of the magnetic toner. As the magnetic material for use in the present invention, a material having a high retention of bivalent iron before/after heating at 160° C. is preferably used, but by use of the wax having a lower melting point, the kneading temperature can be lowered. Accordingly, the oxidation of the magnetic particles can be inhibited, and the reddishness of the magnetic toner caused by the oxidation can be suppressed. By use of the wax having a melting point in a more preferable range, there can be obtained a magnetic toner which indicates an optimum viscosity in the step of kneading the magnetic particles and the binder resin and which is, as a result, superior in the dispersing properties of the magnetic particles in the binder resin.

Furthermore, the magnetic toner of the present invention preferably contains a charge controlling agent. Specific examples of a negative charge controlling agent include: a metal compound of mono azo dye described in Japanese Patent Publication Nos. 41-20153, 42-27596, 44-6397, 45-26478, etc.; a nitrohumic acid and its salt or a dye/pigment such as C.I. 14645 described in Japanese Patent Application Laid-Open No. 50-133838; metal compounds of Zn, Al, Co, Cr, Fe, and Zr of a salicylic acid, a naphthoic acid, and a dicarboxylic acid described in Japanese Patent Publication Nos. 55-42752, 58-41508, 58-7384, 59-7385, etc.; a sulfonated copper phthalocyanine pigment; a styrene olygomer into which a nitro group or halogen is introduced; chlorinated paraffin and the like. Especially, an azo metal compound represented by the following formula (I) or a basic organic acid metal compound represented by the following formula (II) is preferable, because the compound is superior in dispersing properties into the magnetic toner, and is effective in providing the stability of the image density, and reducing the fogging.

(I)

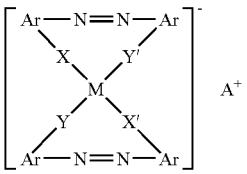

wherein M denotes a configuration center metal and indicates Cr, Co, Ni, Mn, Fe, Ti, or Al. Ar denotes an arylene group such as a phenylene group or a naphthylene group, and may have a substituent group. In this case, examples of the substituent group include a nitro group, a halogen group, a carboxyl group, an anilide group, an alkyl group having 1 to 18 carbon atoms and an alkoxy group having 1 to 18 carbon atoms. X, X', Y and Y' each independently denotes —O—, —CO—, —NH— or —NR— (R denotes an alkyl group having 1 to 4 carbon atoms). $A^+$ denotes hydrogen, a sodium ion, a potassium ion, an ammonium ion, or an aliphatic ammonium ion.

(II)

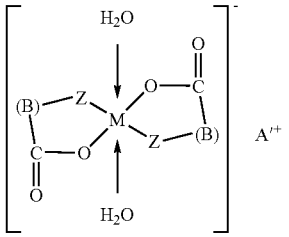

wherein M denotes a configuration center metal and indicates Cr, Co, Ni, Mn, Fe, Ti, Zr, Zn, Si, B, or Al, and (B) is represented by the following:

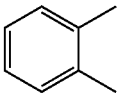

(a substituent group such as an alkyl group may be included), or

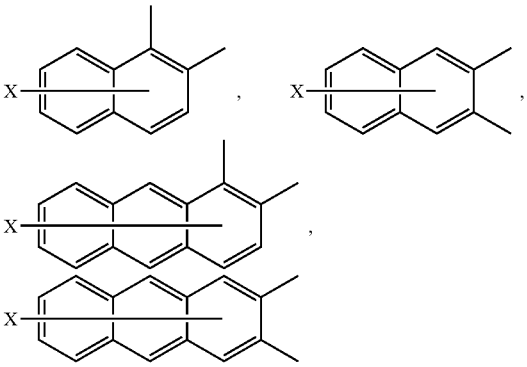

wherein X denotes a hydrogen atom, a halogen atom, or a nitro group, or

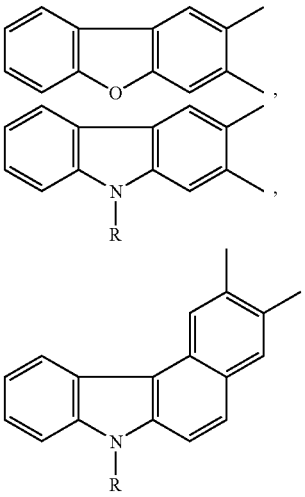

wherein R denotes a hydrogen atom, an alkyl group of $C_1$ to $C_{18}$, or an alkenyl group of $C_2$ to $C_{18}$.

$A'^+$ denotes hydrogen ion, a sodium ion, a potassium ion, an ammonium ion, or an aliphatic ammonium ion.

Z is —O— or —C(=O)—O—.

Among them, the azo metal compound represented by the above formula (I) is more preferable. Above all, an azo iron compound is most preferable whose center metal is Fe and which is represented by the following formula (III) or (IV).

(III)

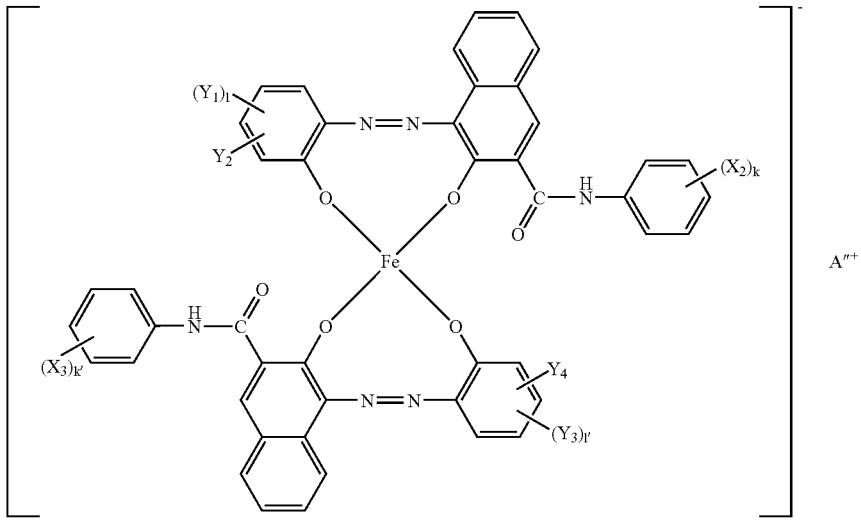

wherein $X_2$ and $X_3$ each denotes a hydrogen atom, a lower alkyl group, a lower alkoxy group, a nitro group or a halogen atom; k and k' each denotes an integer of 1 to 3; $Y_1$ and $Y_3$ each denotes a hydrogen atom, an alkyl group having 1 to 18 carbon atoms, an is alkenyl group having 2 to 18 carbon atoms, a sulfonic amide group, a mesyl group, a sulfonic acid group, a carboxyester group, a hydroxyl group, an alkoxy group having 1 to 18 carbon atoms, an acetyl amino group, a benzoyl group, an amino group or a halogen atom; l and l' each denotes an integer of 1 to 3; and $Y_2$ and $Y_4$ each denotes a hydrogen atom or a nitro group (the above $X_2$ and $X_3$, k and k', $Y_1$ and $Y_3$, l and l', and $Y_2$ and $Y_4$ may be the same or different from each other). Moreover, $A''^{+}$ denotes an ammonium ion, a sodium ion, a potassium ion, a hydrogen ion or mixed ions of them, and preferably has 75 to 98 mol % of ammonium ions.

It is to be noted that in the present invention, in this case, "lower" means that the number of the carbon atoms is 1 to 6.

(IV)

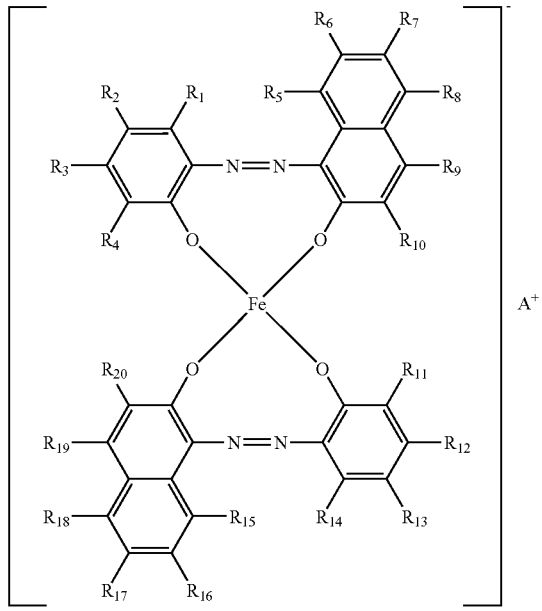

wherein $R_1$ to $R_{20}$ denote hydrogen atoms, halogen atoms, or alkyl groups; and $A^+$ denotes an ammonium ion, a sodium ion, a potassium ion, a hydrogen ion, or mixed ions of them.

Next, specific examples of the azo iron compound represented by the above formula (III) will be shown.

Azo Iron Complex Compound (1)

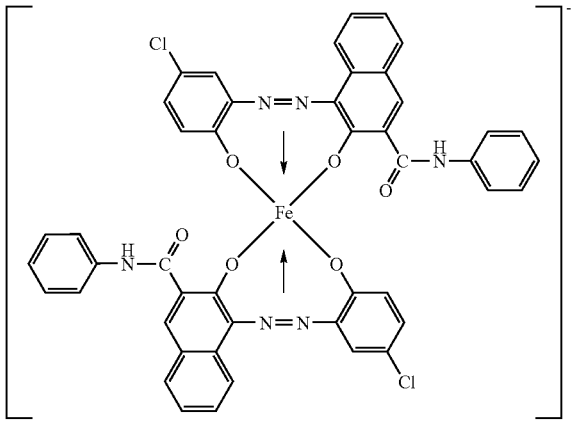

$NH_4^+$ (or $H^+$, $Na^+$, $K^+$, or mixed ions of them)

Azo Iron Complex Compound (2)

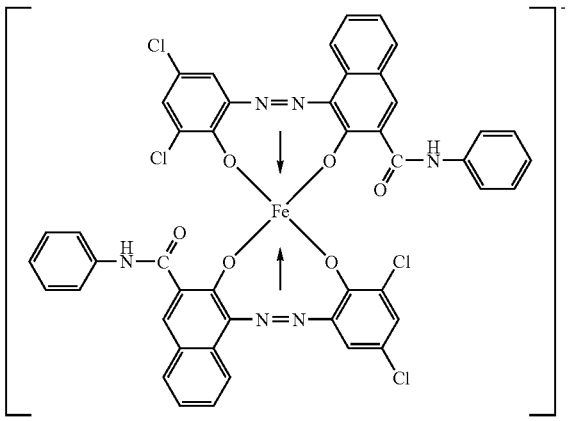

$NH_4^+$ (or $H^+$, $Na^+$, $K^+$, or mixed ions of them)

Azo Iron Complex Compound (3)

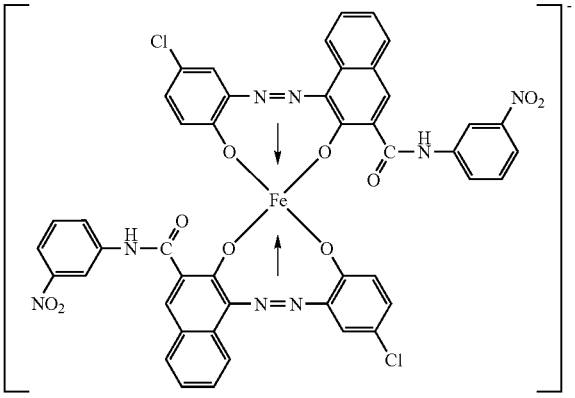

$NH_4^+$ (or $H^+$, $Na^+$, $K^+$, or mixed ions of them)

Azo Iron Complex Compound (4)

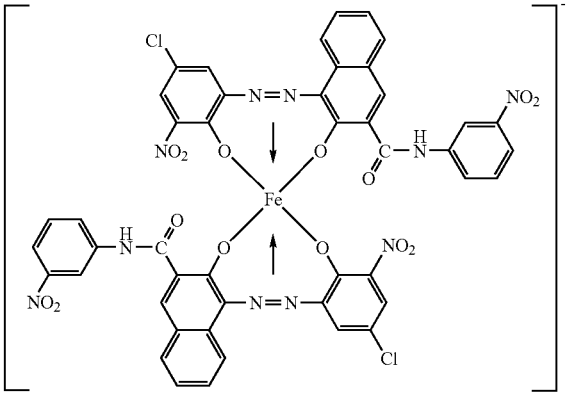

$NH_4^+$ (or $H^+$, $Na^+$, $K^+$, or mixed ions of them)

Azo Iron Complex Compound (5)

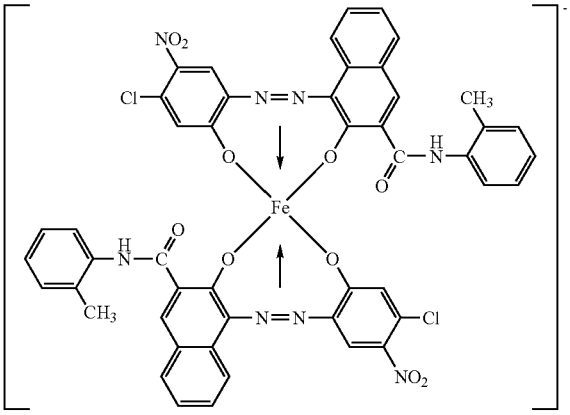

$NH_4^+$ (or $H^+$, $Na^+$, $K^+$, or mixed ions of them)

Azo Iron Complex Compound (6)

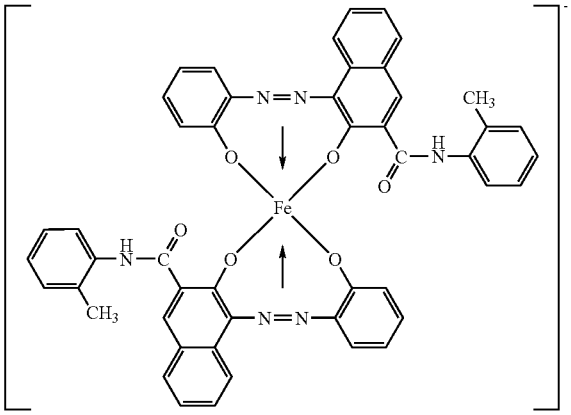

$NH_4^+$ (or $H^+$, $Na^+$, $K^+$, or mixed ions of them)

Furthermore, concrete examples of the charge controlling agents having structures represented by the above equations (I), (II), and (IV) will be shown hereinafter.

Azo Metal Complex Compound (7)

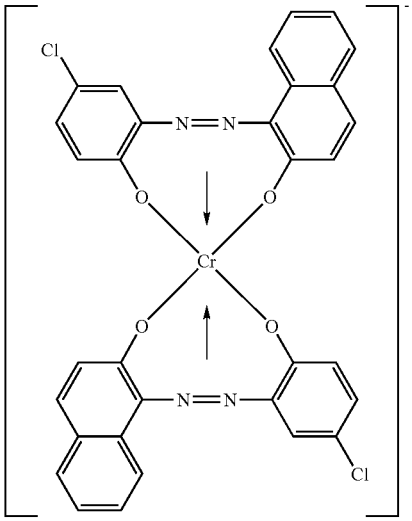

$NH_4^+$ (or $H^+$, $Na^+$, $K^+$, or mixed ions of them)

Azo Metal Complex Compound (8)

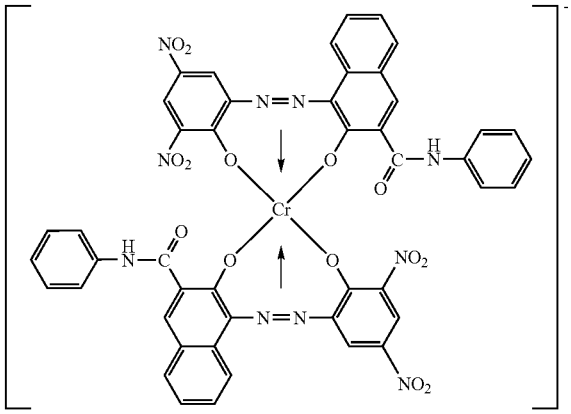

$NH_4^+$ (or $H^+$, $Na^+$, $K^+$, or mixed ions of them)

Basic Organic Acid Metal Compound (9)

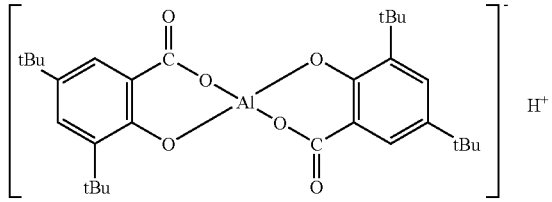

Basic Organic Acid Metal Compound (10)

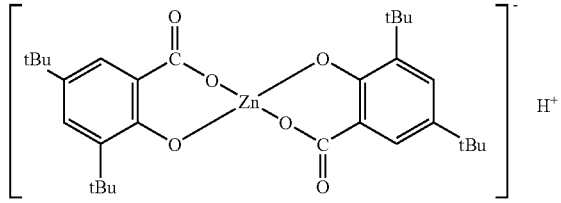

Basic Organic Acid Metal Compound (11)

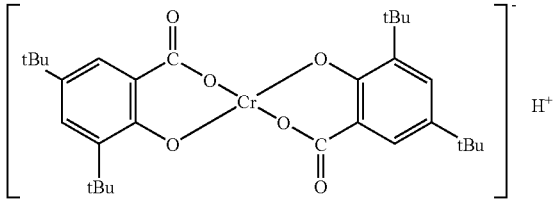

Basic Organic Acid Metal Compound (12)

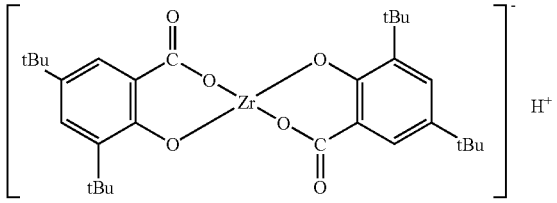

Azo Iron Compound (13)

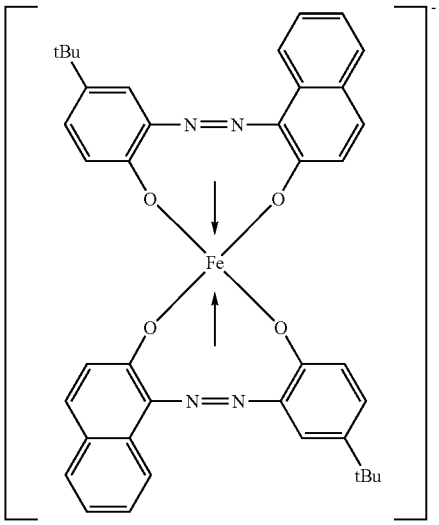

$NH_4^+$ (or $H^+$, $Na^+$, $K^+$, or mixed ions of them)

It is to be noted that tBu in the above formula means a tertiary butyl group.

These metal compounds may be used alone or as a combination of two or more of them. The use amount of the charge controlling agent is preferably 0.1 to 5.0 parts by mass per 100 parts by mass of the binder resin in view of the charged amount of the magnetic toner.

Examples of a preferable negative charge controlling agent on the market include Spilon Black TRH, T-77, T-95 (Hodogaya Chemical Co., Ltd.), BONTRON (registered trademark) S-34, S-44, S-54, E-84, E-88, E-89 (Orient Chemical Industry Co.) and the like.

When the magnetic toner of the present invention is used as a negative chargeable toner, the effects of the present invention are easily exerted.

On the other hand, there are materials for controlling the toner into positive chargeability: nigrosine and modified material by fatty acid metal salt or the like; a quaternary ammonium salt such as tributyl benzyl ammonium-1-hydroxy-4-naphtosulfonate or tetrabutylammonium tetrafluoroborate, onium salt such as phosphonium salt which is analogue thereof, and lake pigment; triphenyl methane dye, and lake pigment (examples of a lake agent include phosphotungstic acid, phosphomolybdic acid, phosphor tungsten molybdic acid, tannic acid, lauric acid, gallic acid, ferricyanide, ferrocyanide, etc.); metal salt of higher fatty acid; diorganotin oxide such as dibutyltin oxide, dioctyltin oxide, or dicyclohexyltin oxide; and diorganotin borate such as dibutyltin borate, dioctyltin borate, or dicyclohexyltin borate. These materials may be used alone or as a combination of two or more of them.

Examples of a commercially available preferable positive charge controlling agent include TP-302, TP-415 (Hodogaya Chemical Co., Ltd.), BONTRON (registered trademark) N-01, N-04, N-07, P-51 (Orient Chemical Industry Co.), copy blue PR (Craliant Co.) and the like.

Moreover, in the magnetic toner of the present invention, a fine inorganic powder or a fine hydrophobic inorganic powder is preferably added/mixed. For example, a fine silica powder is preferably added and used.

As the fine silica powder for use in the present invention, both of so-called dry silica and wet silica are usable. The dry silica is also referred to fumed silica, which is produced by vapor phase oxidation of a silicon halogen compound, and the wet silica is produced from water glass or the like. However, the dry silica is preferable because there are less silanol groups in the surface and the inside of the powder and there is not any prepared residue.

Moreover, the fine silica powder for use in the present invention is preferably subjected to a hydrophobic treatment. Examples of the hydrophobic treatment include a method for chemically treating the powder with an organic silicon compound or the like which is allowed to react with the fine silica powder and which is physically adsorbed by the fine silica powder. As a preferable method, there is a method in which after treating, with a silane compound, the fine dry silica powder produced by the vapor phase oxidation of a silicon halogen compound, or simultaneously with the treating with the silane compound, the powder is treated with an organic silicon compound such as a silicone oil.

Examples of the silane compound for use in the hydrophobic treatment include: hexamethyldisilazane; trimethylsilane; trimethylchlorosilane; trimethylethoxy silane; dimethyldichlorosilane; methyltrichlorosilane; aryldimethylchlorosilane; arylphenyldichlorosilane; benzyldimethylchlorosilane; brommethyldimethylchlorosilane; α-chloroethyltrichlorosilane; β-chloroethyltrichrolosilane; chloromethyldimethylchlorosilane; triorganosilane mercaptan; trimethylsilyl mercaptan; triorganosilyl acrylate; vinyldimethylacetoxysilane; dimethylethoxysilane; dimethyldimethoxysilane; diphenyldiethoxysilane; hexamethyldisiloxane; 1,3-divinyltetramethyldisiloxane; and 1,3-diphenyltetramethyldisiloxane.

Examples of the organic silicon compound include a silicone oil. As a preferable silicone oil, a silicone oil whose viscosity at 25° C. is about $3\times10^{-5}$ to $1\times10^{-3}$ $m^2/s$ is used. The examples of the oil include a dimethyl silicone oil, a methylhydrogen silicone oil, a methylphenyl silicone oil, an α-methylstyrene modified silicone oil, a chrolophenyl silicone oil, fluorine modified silicone oil and the like.

Examples of a silicone oil treatment method include: a method in which the fine silica powder treated with the silane compound is directly mixed with the silicone oil using a mixing unit such as Henschel mixer; and a method in which the silicone oil is jet to silica constituting a base. Another treatment method may be used in which the silicone oil is dissolved or dispersed in an appropriate solvent, and is then mixed with the fine silica powder constituting the base to remove the solvent.

An amount of a fine inorganic powder or a fine hydrophobic inorganic powder to be added/mixed to the magnetic toner is preferably 0.1 to 5.0 parts by mass, more preferably 0.1 to 3.0 parts by mass with respect to 100 parts by mass of magnetic toner.

An additive other than the fine silica powder may be added to the magnetic toner of the present invention if necessary. Examples of the additive include resin particulates and inorganic particulates which function as an auxiliary charging agent, a flowability-imparting agent, a fluidity imparting agent, a caking preventive agent, a lubricant, an abrasive and the like. Specifically, the examples include lubricants such as ethylene polyfluoride, zinc stearate, and vinylidene polyfluoride, and above all, vinylidene polyfluoride is preferable. Moreover, the examples include abrasives such as cerium oxide, silicon carbide, and strontium titanate, and above all, strontium titanate is preferable. Furthermore, the examples include fluidity imparting agents such as titanium oxide and aluminum oxide, and above all, a hydrophobic agent is preferable. Additionally, the examples include a caking preventive agent; and a flowability-imparting agent such as zinc oxide, antimony oxide, or tin oxide. Moreover, small amounts of white and black particulates having reverse polarities may be used as a developing performance improving.

To prepare the magnetic toner of the present invention, a mixture containing at least the binder resin and the magnetic particles is used as a material. Additionally, a wax, a charge controlling agent, and another additive may be used if necessary. These materials are sufficiently mixed by a mixing unit such as Henschel mixer or ball mill, and thereafter they are melted, mixed, and kneaded using a thermal kneader such as a roller, a kneader, or an extruder so that resins are mutually soluble. A pigment or a dye is dispersed or dissolved as a colorant into the materials. After cooling and solidifying, crushing and classifying are performed, so that the magnetic toner can be obtained. The fine silica powder and/or another additive may be added/mixed with respect to the resultant magnetic toner if necessary.

Examples of the mixer for use in manufacturing the magnetic toner include: Henschel Mixer (manufactured by Mitsui Mining Co., Ltd.); Super Mixer (manufactured by Kawata Mfg. Co., Ltd.); Rivocone (manufactured by Ohgawara Mfg. Co.); Nauter Mixer, Turbulizer, Cyclomix (manufactured by Hosokawa Micron Corp.); Spiral Pin Mixer (manufactured by Taiheiyo Kiko Co.); and Redige Mixer (manufactured by Matsubo Co.). Examples of the kneading machine include: KRC Kneader (manufactured by Kurimoto Ltd.); Buss Co Kneader (manufactured by Buss Co., Ltd.); TEM-type Extruder (manufactured by Toshiba Machine Co., Ltd.); TEX Biaxial Kneader (manufactured by NSK Ltd.); PCM Kneader (manufactured by Ikegai Corp.); Three-roll Mill, Mixing Roll Mill, Kneader (manufactured by Inoue Mfg. Co.); Kneadex (manufactured by Mitsui Mining Co., Ltd.); MS-type Pressurizing Kneader, Kneaderuder (manufactured by Moriyama Mfg. Co.); and Bambari Mixer (manufactured by Kobe Steel Ltd.). Examples of a crushing machine include: Counter Jet Mill, Micron Jet, Inomizer (manufactured by Hosokawa Micron Corp.); IDS-type Mill, PJM Jet Crusher (manufactured by Nihon Pneumatic Industry Co.); Cross Jet Mill (manufactured by Kurimoto Ltd.); Urumax (manufactured by Nisso Engineering Co.); SK Jet O Mill (manufactured by Seisin Kigyo Co.); Criptron (manufactured by Kawasaki Heavy Industries, Ltd.); Turbo Mill (manufactured by Turbo Industry Co.); and Super Rotor (manufactured by Nissin Engineering Co.). Examples of a classifying machine include: Classil, Micron Classifier, Spedic Classifier (manufactured by Seisin Kigyo Co.); Turbo Classifier (manufactured by Nissin Engineering Co.); Micron Separator, Turboplex (manufactured by ATP); TSP Separator (manufactured by Hosokawa Micron Corp.); Elbow Jet (manufactured by Nittetsu Mining Co., Ltd.); Dispersion Separator (manufactured by Nihon Pneumatic Industry Co.); and YM Micro Cut (manufactured by Yasukawa Shoji). Examples of a sieve device for use in sieving coarse particles or the like include: Ultrasonic (manufactured by Koei Industry Co.); Resona Sieve, Gyro Shifter (manufactured by Tokuju Mfg. Co.); Vibra Sonic System (manufactured by Dulton Co.); Soni Clean (manufactured by Shinto Industry Co.); Turbo Screener (manufactured by Turbo Industry Co.); Micron Shifter (manufactured by Makino Industry Co.); a circular vibration sieve and the like.

EXAMPLES

The constitution of the magnetic toner of the present invention has been described above, and the present invention will be described hereinafter in accordance with examples. However, the present invention is not limited to the examples. It is to be noted that in the examples, parts mean parts by mass.

Magnetic particles used in the examples are shown in Table 1, and waxes are shown in Table 2. It is to be noted that core magnetic particles, magnetic particles, and a binder resin are manufactured in the following methods.

Preparation Example 1 of Magnetic Particles

After mixing a ferrous sulfuric acid solution with 0.96 equivalent of an aqueous sodium hydroxide solution with respect to $Fe^{2+}$, an aqueous ferrous salt solution containing $Fe(OH)_2$ was produced. Thereafter, 1.0 mass % of silicate of soda in terms of Si to Fe was added. Next, air was passed through the aqueous ferrous iron solution containing $Fe(OH)_2$ at 90° C. to perform an oxidative reaction under a condition of pH 6.5.

Furthermore, after adding to the resultant suspension 1.05 equivalents of the aqueous sodium hydroxide solution with respect to remaining $Fe^{2+}$, in which 0.2 mass % (in terms of Si to Fe) of silicate of soda was dissolved, the suspension was further heated at 90° C. to allow the oxidative reaction under a condition of pH 9.0. Cleaning, filtering, and drying were performed by known methods, and core magnetic particles A were obtained. A content of Si element in the core magnetic particles A was 1.2 mass % with respect to Fe in the core magnetic particles A. It is to be noted that as to the content of the Si element, a content of $SiO_2$ in the core magnetic particles A corresponds to 0.6 mass % on the basis of masses of the core magnetic particles A.

The core magnetic particles A were dispersed in water, and an aqueous suspension having a concentration of 100 g/l was obtained. The aqueous suspension was retained at 80° C. or more, and the aqueous sodium hydroxide solution was added to adjust pH of the aqueous suspension into 9.0. While the aqueous suspension was stirred, 4.7 mass % equivalents of aqueous sodium silicate solution were added in the form of $SiO_2/Fe_3O_4$. Subsequently, a diluted sulfuric acid was added, pH of the aqueous suspension was gradually lowered, and the aqueous suspension was finally neutralized in about four hours. The suspension was cleaned, filtered, dried, and crushed by the normal methods to obtain magnetic particles 1 coated with silica at a high density. The magnetic particles 1 were spherical and had an average particle size of 0.15 μm. A silica coating amount was 4.3 mass % on the basis of the masses of the magnetic particles. It is to be noted that when the treated core magnetic particles A are removed from the aqueous suspension by the cleaning, 0.4 mass % equivalent of the added amount of sodium silicate flowed out. Physical properties of the magnetic particles 1 are shown in Table 1.

Preparation Example 2 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.16 μm. A concentration of silicate of soda added first time was set to 1.5 mass %, and a concentration of silicate of soda added second time was set to 0.3 mass % to set a content of Si in the resultant core magnetic particles to 1.8 mass % with respect to Fe in the core magnetic particles. An added amount of an aqueous sodium silicate solution for coating the core magnetic particles with $SiO_2$ was set to 1.7 mass % equivalents in terms of $SiO_2/Fe_3O_4$. Magnetic particles 2 coated with $SiO_2$ were obtained in the same manner as in Preparation Example 1 of the magnetic particles except the above-described steps. Physical properties of the magnetic particles 2 are shown in Table 1.

Preparation Example 3 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.16 μm. A concentration of silicate of soda added first time was set to 2.3 mass %, and a concentration of silicate of soda added second time was set to 0.6 mass % to set a content of Si in the resultant core magnetic particles to 2.9 mass % with respect to Fe in the core magnetic particles. An added amount of an aqueous sodium silicate solution in coating the core magnetic particles with $SiO_2$ was set to 1.4 mass % equivalents in terms of $SiO_2/Fe_3O_4$. Magnetic particles 3 coated with $SiO_2$ were obtained in the same manner as in Preparation Example 1 of the magnetic particles except the above-described steps. Physical properties of the magnetic particles 3 are shown in Table 1.

Preparation Example 4 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.10 μm. A concentration of silicate of soda added first time was set to 3.0 mass %, and a concentration of silicate of soda added second time was set to 1.0 mass % to set a content of Si in the resultant core magnetic particles to 4.0 mass % with respect to Fe in the core magnetic particles. An added amount of an aqueous sodium silicate solution for coating the core magnetic particles with $SiO_2$ was set to 1.4 mass % equivalents in terms of $SiO_2/Fe_3O_4$. Magnetic particles 4 coated with $SiO_2$ were obtained in the same manner as in Preparation Example 1 of the magnetic particles except the above-described steps. Physical properties of the magnetic particles 4 are shown in Table 1.

Preparation Example 5 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.22 μm. A concentration of silicate of soda added first time was set to 1.3 mass %, and a concentration of silicate of soda added second time was set to 0.5 mass % to set a content of Si in the resultant core magnetic particles to 1.8 mass % with respect to Fe in the core magnetic particles. An added amount of an aqueous sodium silicate solution for coating the core magnetic particles with $SiO_2$ was set to 14.0 mass % equivalents in terms of $SiO_2/Fe_3O_4$. Magnetic particles 5 coated with $SiO_2$ were obtained in the same manner as in Preparation Example 1 of the magnetic particles except the above-described steps. Physical properties of the magnetic particles 5 are shown in Table 1.

Preparation Example 6 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.23 μm. A concentration of silicate of soda added first time was set to 2.0 mass %, and a concentration of silicate of soda added second time was set to 0.6 mass % to set a content of Si in the resultant core magnetic particles to 2.6 mass % with respect to Fe in the core magnetic particles. An added amount of an aqueous sodium silicate solution for coating the core magnetic particles with $SiO_2$ was set to 21.1 mass % equivalents in terms of $SiO_2/Fe_3O_4$, and pH of the solution was adjusted to obtain magnetic particles having octahedron shapes. Magnetic particles 6 coated with $SiO_2$ were obtained in the same manner as in Preparation Example 1 of the magnetic particles except the above-described steps. Physical properties of the magnetic particles 6 are shown in Table 1.

Preparation Example 7 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.07 μm. A concentration of silicate of soda added first time was set to 1.4 mass %, and a concentration of silicate of soda added second time was set to 0.6 mass % to set a content of Si in the resultant core magnetic particles to 2.0 mass % with respect to Fe in the core magnetic particles. An added amount of an aqueous sodium silicate solution for coating the core magnetic particles with $SiO_2$ was set to 23.0 mass % equivalents in terms of $SiO_2/Fe_3O_4$. Magnetic particles 7 coated with $SiO_2$ were obtained in the same manner as in Preparation Example 1 of the magnetic particles except the above-described steps. Physical properties of the magnetic particles 7 are shown in Table 1.

Preparation Example 8 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.12 μm, and silicate of soda was not added. An added amount of an aqueous sodium silicate solution in coating the core magnetic particles with $SiO_2$ was set to 19.5 mass % equivalents in terms of $SiO_2/Fe_3O_4$. Magnetic particles 8 coated with $SiO_2$ were obtained in the same manner as in Preparation Example 1 of the magnetic particles except the above-described steps. Physical properties of the magnetic particles 8 are shown in Table 1.

Preparation Example 9 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.22 μm. A concentration of silicate of soda added first time was set to 1.5 mass %, and a concentration of silicate of soda added second time was set to 0.3 mass % to set a content of Si in the resultant core magnetic particles to 1.8 mass % with respect to Fe in the core magnetic particles. At the time of coating of the core magnetic particles, instead of an aqueous sodium silicate solution, 3.5 mass % equivalents of aqueous manganese sulfate solution in terms of $MnO/Fe_3O_4$ were added. Magnetic particles 9 coated with MnO were obtained in the same manner as in Preparation Example 1 of the magnetic particles except the above-described steps. Physical properties of the magnetic particles 9 are shown in Table 1.

Preparation Example 10 of Magnetic Particles

In the preparation of the core magnetic particles A of Preparation Example 1 of the magnetic particles, a concentration of sodium hydroxide to be added to a ferrous sulfuric acid solution was adjusted to set an average particle size of the resultant core magnetic particles to 0.10 μm. A concentration of silicate of soda added first time was set to 3.0 mass %, and a concentration of silicate of soda added second time was set to 1.0 mass % to set a content of Si in the resultant core magnetic particles to 4.0 mass % with respect to Fe in the core magnetic particles. The core magnetic particles were not coated with $SiO_2$, and magnetic particles 10 were obtained. Physical properties of the magnetic particles 10 are shown in Table 1.

insoluble content. An isoelectric point of the binder resin 1 was pH 2.4.

Preparation Example 2 of Binder Resin

Condensation polymerization was performed in the same manner as in Preparation Example 1 except that a monomer constitution comprised: 40 parts by mass of PO 2-mol addition product of bisphenol A; 70 parts by mass of EO 2-mol addition product of bisphenol A; 50 parts by mass of terephthalic acid; 1 part by mass of trimellitic anhydride; and 0.5 part by mass of dibutyltin oxide in Preparation Example 1 of the binder resin. A binder resin 2 was obtained which was a polyester resin. The binder resin 2 had an acid value of 3.6 mgKOH/g, a hydroxyl group value of 22 mgKOH/g, Tg at 65° C., Mw of 50,000, and 4 mass % of THF insoluble content. An isoelectric point of the binder resin 2 was pH 3.1.

TABLE 1

Physical Properties of Magnetic Particles

| | Powder properties | | | | | | | |
|---|---|---|---|---|---|---|---|---|
| | Isoelectric point pH | Content of $SiO_2$ in magnetic particle surfaces [mass %] | Adsorbed moisture amount* [wt %/g $SiO_2$] | Average particle size [μm] | Shape | Amount of $Fe^{2+}$ before heating [mass %] | Amount of $Fe^{2+}$ after heating [mass %] | Retention [%] |
| Magnetic particles 1 | 1.4 | 4.3 | 7.3 | 0.15 | Spherical | 20.5 | 18.2 | 89 |
| Magnetic particles 2 | 2.8 | 1.3 | 6.0 | 0.16 | Spherical | 19.7 | 16.2 | 82 |
| Magnetic particles 3 | 3.3 | 0.98 | 17 | 0.16 | Spherical | 20.6 | 16.5 | 80 |
| Magnetic particles 4 | 3.9 | 0.65 | 89 | 0.10 | Spherical | 17.9 | 11.1 | 62 |
| Magnetic particles 5 | 2.9 | 13.5 | 26 | 0.22 | Spherical | 20.3 | 17.1 | 84 |
| Magnetic particles 6 | 3.5 | 20.7 | 22 | 0.23 | Octahedron | 21.0 | 16.4 | 78 |
| Magnetic particles 7 | 3.8 | 22.6 | 11 | 0.07 | Spherical | 16.8 | 11.3 | 67 |
| Magnetic particles 8 | 3.7 | 18.9 | 89 | 0.12 | Spherical | 20.9 | 14.2 | 68 |
| Magnetic particles 9 | 4.3 | 0.00** | 130 | 0.22 | Spherical | 20.3 | 11.0 | 54 |
| Magnetic particles 10 | 6.0 | 0.00 | — | 0.10 | Spherical | 17.8 | 6.4 | 36 |

*Adsorbed moisture amount per unit mass of coating silica (relative vapor pressure of 50%)
**Coated with 3.0% of manganese oxide Preparation Example 1 of Binder Resin 40 parts by mass of propylene oxide (PO) 2-mol addition product of bisphenol A, 30 parts by mass of ethylene oxide (EO) 2-mol addition product of bisphenol A, 25 parts by mass of terephthalic acid, 4 parts by mass of fumaric acid, 5 parts by mass of trimellitic anhydride, and 0.5 part by mass of dibutyltin oxide were placed in a reaction bath. They were condensed/polymerized at 220° C., and a binder resin 1 was obtained which was a polyester resin. The binder resin 1 had an acid value of 22 mgKOH/g, a hydroxyl group value of 32 mgKOH/g, a glass-transition temperature (Tg) at 59° C., Mw of 220,000, and 14 mass % of tetrahydrofuran (THF)

Preparation Example 3 of Binder Resin

Condensation polymerization was performed in the same manner as in Preparation Example 1 except that a monomer constitution comprised: 100 parts by mass of PO 2-mol addition product of bisphenol A; 32 parts by mass of isophthalic acid; 12 parts by mass of terephthalic acid; 1 part by mass of trimellitic anhydride; and 0.5 part by mass of dibutyltin oxide in Preparation Example 1 of the binder resin. A binder resin 3 was obtained which was a polyester resin. The binder resin 3 had an acid value of 2.0 mgKOH/g, Mw of 60,000, a hydroxyl group value of 54 mgKOH/g, Tg at 52° C., and 0 mass % of THF insoluble content. An isoelectric point of the binder resin 3 was pH 2.1.

Preparation Example 4 of Binder Resin

Condensation polymerization was performed in the same manner as in Preparation Example 1 except that a monomer constitution comprised: 40 parts by mass of EO 2-mol addition product of bisphenol A; 12 parts by mass of terephthalic acid; 7 parts by mass of trimellitic anhydride; 5 parts by mass of dodecenyl succinate; and 0.5 part by mass of dibutyltin oxide in Preparation Example 1 of the binder resin. A binder resin 4 was obtained which was a polyester resin. The binder resin 4 had an acid value of 42 mgKOH/g, a hydroxyl group value of 4.8 mgKOH/g, Mw of 280,000, Tg at 55° C., and 5 mass % of THF insoluble content. An isoelectric point of the binder resin 4 was pH 2.2.

Preparation Example 5 of Binder Resin 300 parts by mass of xylene were poured into a four-mouth flask, temperature was raised, xylene was refluxed, and a mixed solution of 80 parts by mass of styrene, 20 parts by mass of acrylic acid-n-butyl, and 2 parts by mass of di-tert-butylperoxide was dropped in five hours to obtain a low-molecular-weight polymer (L-1) solution.

Furthermore, after pouring 180 parts by mass of deaerated water, and 20 parts by mass of 2 mass % aqueous solution of polyvinyl alcohol into the four-mouth flask, a mixed solution of 75 parts by mass of styrene, 25 parts by mass of acrylic acid-n-butyl, 0.005 part by mass of divinylbenzene, and 0.1 part by pass of 2,2-bis (4,4-di-tert-butylperoxycyclohexyl) propane (half-value period of ten hours at temperature of 92° C.) The solution was stirred to obtain a suspension was added. After sufficiently replacing the inside air of the flask with nitrogen, temperature was raised to 85° C., and the suspension was polymerized and retained for 24 hours. Thereafter, 0.1 part by mass of benzoyl peroxide (half-value period of ten hours at temperature of 72° C.) was added, and further retained for 12 hours to complete the polymerization of a high-molecular-weight polymer (H-1).

After 25 parts by mass of the high-molecular-weight polymer (H-1) was added to 300 parts by mass of uniform solution of the low-molecular-weight polymer (L-1), and sufficiently mixed in reflux, an organic solvent was retained and removed to obtain a styrene-based binder resin 5. The binder resin 5 had an acid value of 0 mgKOH/g, a hydroxyl group value of 0 mgKOH/g, Tg at 57° C., Mw of 300,000, and 0 mass % of THF insoluble content. An isoelectric point of the binder resin 5 was pH 4.8.

Example 1

| | |
|---|---|
| Binder resin 1 | 100 parts by mass |
| Magnetic particles 1 | 90 parts by mass |
| Wax 4 (see Table 2) | 4 parts by mass |
| Charge controlling agent T-77 (Hodogaya Chemical Co., Ltd.) | 2 parts by mass |

A mixture of them was melted and kneaded by a biaxial extruder heated at 140° C., a cooled kneaded material was coarsely crushed by a hammer mill, the coarsely crushed material was finely crushed by a jet mill, and the resultant finely crushed powder was classified by a fixed wall-type wind force classifier to produce the classified powder. Furthermore, the resultant classified powder was treated by a multidivisional classifying device (Elbow Jet Classifier manufactured by Nittetsu Mining Co., Ltd.) using Coanda effect. Accordingly, superfine and coarse powders were simultaneously and strictly classified/removed to obtain negative chargeable magnetic toner particles having a weight average particle size (D4) of 6.7 μm. With respect to 100 parts by mass of the resultant magnetic toner particles, 1.2 parts by mass of fine hydrophobic silica powder, subjected to a hydrophobic treatment and having a BET specific surface area of 120 $m^2/g$, were externally added and mixed to prepare a magnetic toner 1.

As a test printer for evaluation of this magnetic toner 1, a commercially available LBP printer (LBP-950, manufactured by Canon Inc.) with a modification in which a print speed was 1.5-fold increased was used. By use of this tester, print tests of 20,000 sheets were made in an environment of 30° C. and 80% RH (high temperature and high humidity) and in an environment of 15° C. and 10% RH (low temperature and low humidity), and the following evaluations were given.

(1) Image Density

Images were printed out onto 20,000 sheets of plain paper (75 $g/m^2$) for a usual copying machine in a high temperature and humidity (30° C., 80% RH) environment, and image densities at start and end of the printing were evaluated. It is to be noted that as to the image density, a relative density of a white portion (i.e., plain paper for a copying machine before image formation) with respect to a printed-out image was measured using Macbeth densitometer (manufactured by Macbeth Co.) and SPI filter. Evaluation results are shown in Table 4.

(2) Sleeve Negative Ghost

Images were printed out onto 20,000 sheets of plain paper (75 $g/m^2$) for the usual copying machine in a low temperature and humidity (15° C., 10% RH) environment, and sleeve negative ghost was evaluated every 5,000 sheets. During the image evaluation concerning the ghost, a half-tone image was output followed by outputting a solid black strip-shaped image only in one cycle of the sleeve. In one sheet of printed image, there was a difference in a reflection density measured by Macbeth density reflectometer between a portion (solid black printed portion) where a black image was formed in a first cycle and a portion (non-image portion) where the image was not formed in a second cycle of the sleeve. The difference was calculated using the following equation.

Reflection density difference=reflection density (portion where any image is not formed)−reflection density (portion where the image is formed)

Negative ghost indicates a ghost phenomenon in which, in general, in an image appearing in the sleeve second cycle, the image density of a portion which was printed as black in the sleeve first cycle is lower than that of the non-image portion in the sleeve first cycle, and a pattern produced in the first cycle appears as such. The density difference was measured as the reflection density difference. When the reflection density difference is small, it is indicated that any ghost dose not occur, and the printing is satisfactory. The resultant reflection density differences are divided into the following four stages A, B, C, D, and a worst result in the evaluation every 5,000 sheets is shown as general evaluation of the ghost in Table 4.

A: reflection density difference of 0.00 or more and less than 0.02

B: reflection density difference of 0.02 or more and less than 0.04

C: reflection density difference of 0.04 or more and less than 0.06

D: reflection density difference of 0.06 or more (3) Consumption of Magnetic Toner After outputting 1,000 sheets of images in a low temperature and humidity environment (15° C., 10% RH) using the above-mentioned printer, a latent image line width was set to 360 μm in a 10-dot horizontal-line pattern at 600 dpi. Images were output onto 5,000 sheets having A4 sizes at a printing ratio of 4% to obtain, as consumption of the magnetic toner, a change in magnetic toner amount in a developing unit before/after the output. Results are shown in Table 4.

(4) Colorimetry

Blackness of the magnetic toner was measured by the following method. A solid black image was output on plain paper (75 g/m$^2$) for a usual copying machine, and the blackness was measured by a spectrophotometer "Spectrolino" (manufactured by Gretag Macbeth Co.). The blackness was evaluated with numeric values indicated by lightness L*, a* indicating a degree of red or green, and b* indicating a degree of yellow or blue, in an L*, a*, b* color coordinate system standardized in the International Commission on Illumination. During the evaluation, a quantity of exposure light was adjusted in such a manner that L* is in a range of 18 to 22, and the solid black image was output. As to the blackness, the lower numeric values of both of a*, b* indicate stronger blackness. Evaluation results are shown in Table 4.

Examples 2 to 8

Magnetic toners 2 to 8 were prepared in the same manner as in Example 1 except that constitutions of the magnetic toners were changed as shown in Table 3, and similar evaluations were performed. Results are shown in Table 4.

Comparative Examples 1 and 2

Magnetic toners 9 and 10 were prepared in the same manner as in Example 1 except that constitutions of the magnetic toners were changed as shown in Table 3, and similar evaluations were performed. Results are shown in Table 4.

TABLE 2

| Wax | | | | |
|---|---|---|---|---|
| | Type | Melting point | Mw | Hydroxyl group value [mgKOH/g] |
| Wax 1 | Polypropylene wax | 140 | 8700 | — |
| Wax 2 | Polyethylene | 115 | 1360 | — |
| Wax 3 | Paraffin wax | 73 | 500 | — |
| Wax 4 | Fischer Tropsch wax | 100 | 1290 | — |
| Wax 5 | Higher alcohol wax | 110 | 547 | 43 |

TABLE 3

| Constitution of Magnetic Toner | | | | |
|---|---|---|---|---|
| | Magnetic toner No. | Binder resin | Magnetic particles | Wax |
| Example 1 | 1 | Resin 1 | Magnetic particles 1 | Wax 4 |
| Example 2 | 2 | Resin 1 | Magnetic particles 2 | Wax 5 |
| Example 3 | 3 | Resin 1 | Magnetic particles 3 | Wax 4 |
| Example 4 | 4 | Resin 3 | Magnetic particles 4 | Wax 2 |
| Example 5 | 5 | Resin 2 | Magnetic particles 5 | Wax 5 |
| Example 6 | 6 | Resin 3 | Magnetic particles 6 | Wax 1 |
| Example 7 | 7 | Resin 4 | Magnetic particles 7 | Wax 3 |
| Example 8 | 8 | Resin 4 | Magnetic particles 8 | Wax 2 |
| Comp. Example 1 | 9 | Resin 2 | Magnetic particles 9 | Wax 3 |
| Comp. Example 2 | 10 | Resin 5 | Magnetic particles 10 | Wax 1 |

TABLE 4

| Evaluation Results of Magnetic Toners at High Temperature and Humidity (30° C., 80% RH) and Low Temperature and Humidity (15° C., 10% RH) | | | | | | | |
|---|---|---|---|---|---|---|---|
| | High temperature and humidity | Low temperature and humidity ghost | | | | | |
| | | Durability after outputs of | | Consumption | Colorimetry | | |
| | Density [%] | Initial | 20,000 sheets | [mg/sheet] | L* | a* | b* |
| Example 1 | 1.48 | A | A | 40.1 | 19.6 | 0.65 | −0.98 |
| Example 2 | 1.47 | A | A | 41.3 | 19.4 | 0.68 | −0.81 |
| Example 3 | 1.44 | B | B | 41.5 | 19.1 | 0.83 | −0.67 |
| Example 4 | 1.38 | D | D | 45.8 | 19.0 | 0.88 | −0.45 |
| Example 5 | 1.40 | B | B | 48.6 | 19.8 | 0.72 | −0.72 |
| Example 6 | 1.41 | C | C | 47.0 | 19.8 | 1.03 | 0.15 |
| Example 7 | 1.45 | C | C | 47.5 | 19.8 | 1.27 | 0.61 |
| Example 8 | 1.44 | B | B | 48.9 | 21.1 | 1.15 | −0.56 |
| Comp. Example 1 | 1.40 | C | D | 46.8 | 19.7 | 1.32 | −0.35 |
| Comp. Example 2 | 1.35 | D | D | 44.7 | 20.1 | 1.22 | −0.6 |

According to the present invention, when magnetic particles having an isoelectric point of pH 4.0 or less are contained in a toner, a magnetic toner can be obtained which is superior in fluidity and dispersing properties. As a result, a high-quality image, which has an optimum charged amount regardless of environments, can be provided without causing any ghost phenomenon. Moreover, since a stable charged amount is maintained, consumption of the magnetic toner can be reduced. Furthermore, since the magnetic particles are not easily oxidized, an image, which has high blackness, can be provided. This application claims priority from Japanese Patent Application No. 2004-296445 filed Oct. 8, 2004, which is hereby incorporated by reference herein.

What is claimed is:

1. A magnetic toner comprising magnetic toner particles including at least a binder resin and magnetic particles, wherein an isoelectric point of the magnetic particles is pH 4.0 or less, and wherein the magnetic particles contain in the surfaces thereof 0.8 to 20.0 mass % of $SiO_2$ with respect to a total amount of the magnetic particles.

2. The magnetic toner according to claim 1, wherein the magnetic particles comprise at least core magnetic particles and an $SiO_2$-containing coating layer on the core magnetic particles, and an adsorbed moisture amount of the magnetic particles at a relative vapor pressure of 50% is in a range of 1 to 100 mass % with respect to $SiO_2$ per unit mass in the coating layer.

3. The magnetic toner according to claim 1, wherein the magnetic particles comprise at least core magnetic particles and an $SiO_2$-containing coating layer on the core magnetic particles, and a retention of $Fe^{2+}$ in the magnetic particles is 60% or more at a time when the magnetic particles are thermally treated in air at 160°C. for one hour.

4. The magnetic toner according to claim 1, wherein an average particle size of the magnetic particles is in a range of 0.08 to 0.25 μm.

5. The magnetic toner according to claim 1, wherein an acid value of the binder resin is in a range of 1 to 50 mgKOH/g.

6. The magnetic toner according to claim 1, wherein the binder resin has at least a polyester unit.

7. The magnetic toner according to claim 1, wherein the isoelectric point of the binder resin is in a range of pH 2.0 to 4.0.

8. The magnetic toner according to claim 7, wherein assuming that the isoelectric point of the magnetic particles is X, and the isoelectric point of the binder resin is Y, a difference (X-Y) between the isoelectric point X of the magnetic particles and the isoelectric point Y of the binder resin satisfies the following equation (i):

$$-2.0 \leqq (X-Y) \leqq 2.0 \quad \text{(i)}.$$

* * * * *